US005552559A

United States Patent [19]

Sugiyama et al.

[11] Patent Number: 5,552,559

[45] Date of Patent: Sep. 3, 1996

[54] KEYBOARD MUSICAL INSTRUMENT EQUIPPED WITH HAMMER SENSORS CHANGING POSITION BETWEEN RECORDING MODE AND SILENT MODE

[75] Inventors: Nobuo Sugiyama; Kiyoshi Kawamura, both of Shizuoka, Japan

[73] Assignee: Yamaha Corporation, Japan

[21] Appl. No.: 411,551

[22] Filed: Mar. 28, 1995

[30] Foreign Application Priority Data

Mar. 31, 1994 [JP] Japan ..... 6-085722

[51] Int. Cl.[6] ..... G10D 15/00

[52] U.S. Cl. ..... 84/171; 84/719; 84/243

[58] Field of Search ..... 84/601, 719, 171, 84/220, 221, 236, 243, 423 R

[56] References Cited

U.S. PATENT DOCUMENTS

| | | | |
|---|---|---|---|
| 527,533 | 10/1894 | McChesney et al. | 84/224 |
| 533,661 | 2/1895 | McChesney et al. | 84/224 |
| 3,626,078 | 12/1971 | Sekiguchi | 84/737 |
| 4,067,253 | 1/1978 | Wheelwright et al. | 84/687 |
| 4,633,753 | 1/1987 | Takahashi | 84/220 |
| 4,704,931 | 11/1987 | Nagai et al. | 84/1.01 |
| 4,858,508 | 8/1989 | Shibukawa | 84/1.01 |
| 4,908,121 | 3/1990 | Usa et al. | 84/606 |
| 4,909,119 | 3/1990 | Morokuma | 84/702 |
| 5,117,728 | 6/1992 | Shibukawa et al. | 84/633 |
| 5,136,916 | 8/1992 | Shibukawa | 84/627 |
| 5,166,464 | 11/1992 | Sakata et al. | 84/662 |
| 5,210,367 | 5/1993 | Taguchi et al. | 84/746 |
| 5,241,130 | 8/1993 | Shibukawa | 84/659 |
| 5,374,775 | 12/1994 | Kawamura et al. | 84/615 |
| 5,386,083 | 1/1995 | Kawamura | 84/719 |
| 5,428,186 | 6/1995 | Kaneko et al. | 84/719 |
| 5,434,349 | 7/1995 | Kawamura | 84/719 |
| 5,444,181 | 8/1995 | Wada et al. | 84/719 |
| 5,463,184 | 10/1995 | Kawamura | 84/719 |

FOREIGN PATENT DOCUMENTS

| | | |
|---|---|---|
| 3707591C1 | 5/1988 | Germany . |
| TO91U0077 | 10/1992 | Italy . |
| 61-245194 | 10/1986 | Japan . |
| 62-32308 | 8/1987 | Japan . |
| 4-19592 | 5/1992 | Japan . |
| 5-74834 | 10/1993 | Japan . |

*Primary Examiner*—Patrick J. Stanzione
*Attorney, Agent, or Firm*—Graham & James LLP

[57] ABSTRACT

A keyboard musical instrument has an acoustic piano for generating acoustic sound in an acoustic sound mode, an electronic sound generating system for generating electronic sounds on the basis of detecting signals of hammer sensors in an electronic sound mode and a stopper operative to prevent strings from hammers in the electronic sound mode, and a change-over mechanism changes the hammer sensors between a closed position and a spaced position so that the electronic sound generating system exactly determines the intensities of the electronic sounds.

26 Claims, 19 Drawing Sheets

KEYBOARD MUSICAL INSTRUMENT EQUIPPED WITH HAMMER SENSORS CHANGING POSITION BETWEEN RECORDING MODE AND SILENT MODE

FIELD OF THE INVENTION

This invention relates to a keyboard musical instrument and, more particularly, to a keyboard musical instrument equipped with hammer sensors for recording a performance and generating electronic tones instead of acoustic tones.

DESCRIPTION OF THE RELATED ART

A typical example of the keyboard musical instrument for selectively generating electronic tones and acoustic tones is disclosed in Japanese Patent Application No. 4-174813. The keyboard musical instrument proposed in the Japanese Patent Application is equipped with a silent mechanism and an electronic sound generating system, and the key sensors monitors the key motions for providing music data information to the tone generator. U.S. Ser. No. 08/073,092 was filed claiming the priority right on the basis of Japanese Patent Application No. 4-174813 together with other Japanese Patent Applications. Although several prior arts opposed against U.S. Ser. No. 4-174813, the U.S. patent application was patented, and U.S. Pat. No. 5,374,775 was issued on Dec. 20, 1994. The references cited in the patent prosecution are U.S. Pat. Nos. 2,250,065, 4,633,753, 4,704,931, 4,744,281, 4,970,929, 5,115,705 and 5,247,129 and Foreign Patent documents 44782 (Germany), 68406 (Germany), 97885 (Germany), 3707591 (Germany) and 3707591C1 (Germany), To9-1U000077 (Italy), 51-67732 (Japan), 55-55880 (Japan), 62-32308 (Japan), 637997 (Japan) and 614303 (Switzerland).

However, the key motion is not strictly corresponding to the hammer action, and the electronic sounds are not always faithful to player's intention given through the keyboard. For example, while the player is rapidly and shallowly repeating a key, the keyboard musical instrument repeatedly generates a soft tone. However, the electronic sound generating system repeatedly generates a loud tone, because the key is moved at high speed in the rapid shallow repetition.

Trainees may not notice the difference in the loudness. However, a professional pianist thinks the difference serious, and a keyboard musical instrument equipped with both key and hammer sensors was proposed in Japanese Patent Application No. 4-279470, and U.S. Ser. No. 08,123,294 was file claiming the priority right on the basis of the Japanese Patent Application. The intensity of an impact of a hammer on strings is proportional to the final hammer velocity, and the hammer sensor is arranged in such a manner as to detect a hammer velocity as close to the final hammer velocity as possible. If the keyboard musical instrument does not have a recording mode, the hammer sensors are expected to detect the hammer velocities in the silent mode only, and the sensor positions are determined by the stopper. However, if a manufacturer wants to give a recording mode to the keyboard musical instrument, the keyboard musical instrument requires two sets of hammer sensors, because the closest position is varied between the recording mode and the silent mode. The two sets of hammer sensors increase the production cost, and make the structure of the keyboard musical instrument complex.

SUMMARY OF THE INVENTION

It is therefore an important object of the present invention to provide a keyboard musical instrument which faithfully generates electronic sounds instead of acoustic sounds and record an original performance without sacrifice of a production cost and a simple structure.

To accomplish the object, the present invention proposes to change the positions of hammer sensors between a silent mode and a recording mode.

In accordance with the present invention, there is provided a keyboard musical instrument having at least an acoustic sound mode and an electronic sound mode, comprising: an acoustic piano including a plurality of keys respectively assigned notes of a scale, and selectively moved between respective rest positions and respective end positions by a player, a plurality of key action mechanisms functionally connected to the plurality of keys, respectively, and selectively actuated by the plurality of keys, a plurality of string means vibratory for generating acoustic sounds respectively having the notes, and a plurality of hammer means functionally connected to the plurality of key action mechanisms, respectively, and resting in respective home positions when the plurality of keys are in the respective rest positions, the plurality of hammer means being selectively driven by the plurality of key action mechanisms for striking the associated string means; a silent system shifted between a free position in the acoustic sound mode and a blocking position in the electronic sound mode, the silent mechanism in the free position allowing the plurality of hammer means to strike the plurality of string means, the silent mechanism in the blocking position causing the plurality of hammer means driven by the plurality of key action mechanisms to return to the home positions on the way to the plurality of string means without a strike; and an electronic system including a plurality of hammer sensors respectively associated with the plurality of hammer means, and operative to generate detecting signals respectively indicative of motions of the plurality of hammer means, a change-over mechanism connected to the plurality of hammer sensors, and shifting the plurality of hammer sensors between a closed position in the acoustic sound mode and a spaced position in the electronic sound mode, the closed position being closer to the plurality of string means than the spaced position, and a data signal generating means responsive to the detecting signal for generating pieces of music data indicative of a performed music.

BRIEF DESCRIPTION OF THE DRAWINGS

The features and advantages of the keyboard musical instrument according to the present invention will be more clearly understood from the following description taken in conjunction with the accompanying drawings in which.

DESCRIPTION OF THE PREFERRED EMBODIMENTS

FIRST EMBODIEMENT

Figure 1:
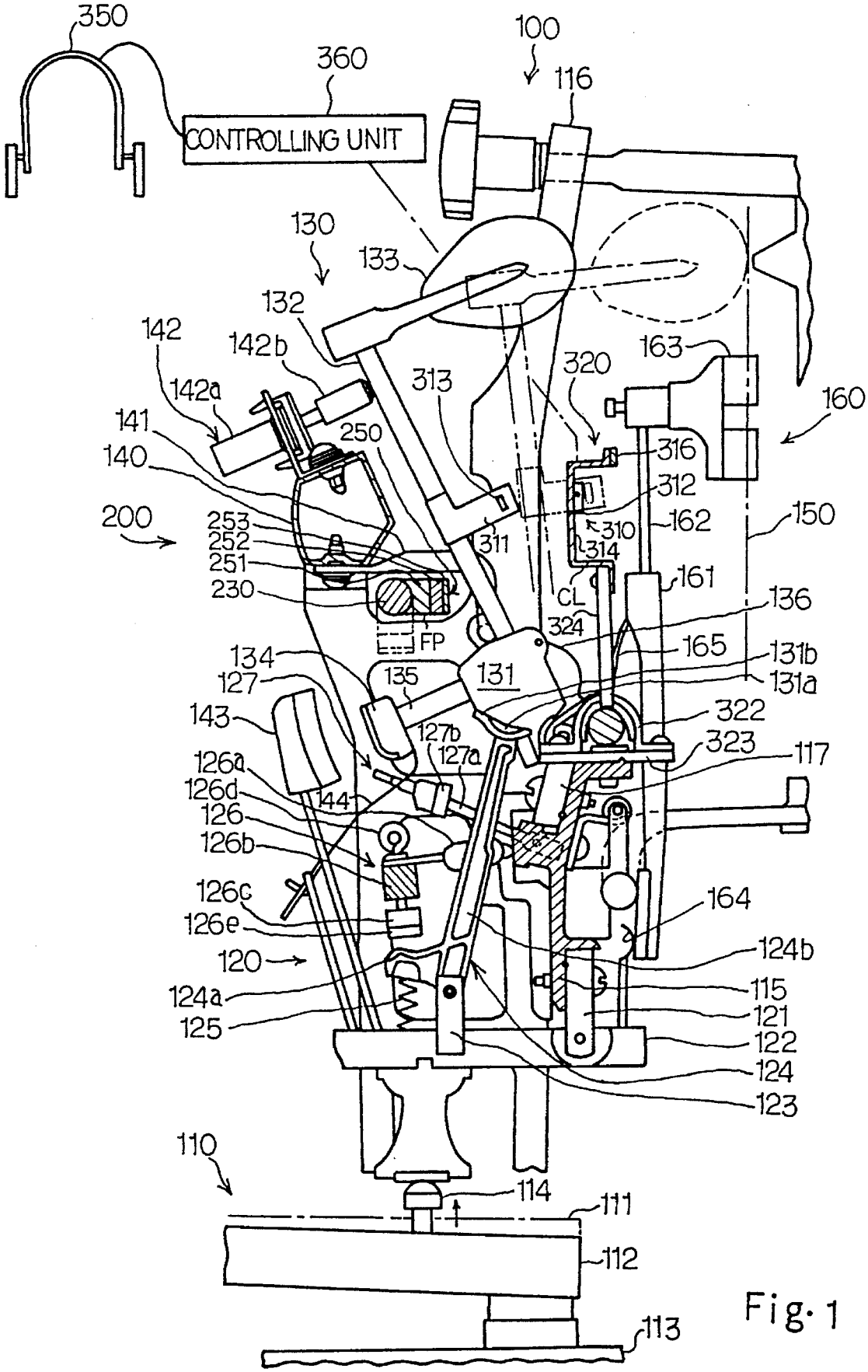
FIG. 1 is a side view showing essential parts of a keyboard musical instrument in an acoustic sound mode or a recording mode according to the present invention.
Figure 2:
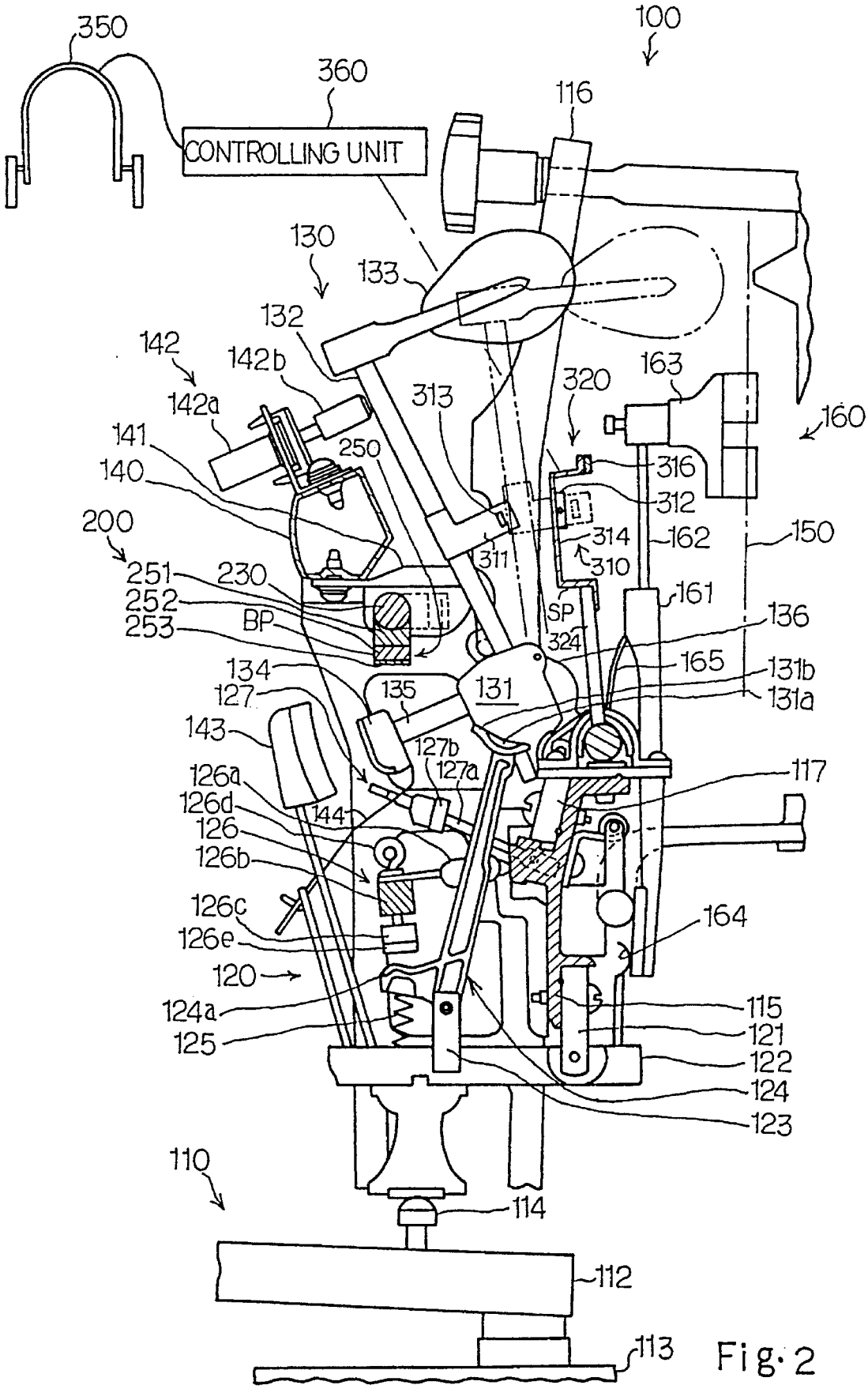
FIG. 2 is a side view showing the essential parts of the keyboard musical instrument in and electronic sound mode.

Referring first to FIGS. 1 and 2 of the drawings, a keyboard musical instrument embodying the present invention largely comprises an acoustic piano 100, a silent system 200 and an electronic recording/sound generating system 300, and has at least a standard acoustic sound mode, a recording mode and an electronic sound mode. The electronic recording/sound generating system 300 records a performance in any one of the standard recording mode and the electronic sound mode. In this instance, the standard acoustic sound mode is an acoustic sound mode. The keyboard musical instrument may directly supply music data information to another electronic musical instrument without storing in a memory, and have only the standard acoustic sound mode and the electronic sound mode. In the following description, word "front" means a closer side to a player siting on a stool, and words "clockwise" and "counter clockwise" are determined on a referenced figure.

The acoustic piano 100 comprises a keyboard 110, and a plurality of black and white keys 111 and 112 form the keyboard 110. Though not shown in FIG. 1, the black and white keys 111 and 112 are turnably supported by a balance rail, and the balance rail is mounted on a key bed 113. Capstan screws 114 project from the rear end positions of the black and white keys 112 and 113, respectively. While a player is exerting a force on the black and white keys 111 and 112, the black and white keys 111 and 112 are traveling from respective rest positions to respective end positions.

The acoustic piano 100 further comprises a plurality of key action mechanisms 120 functionally connected to the capstan buttons 114 of the black and white keys 111 and 112, respectively. The key action mechanisms 120 are similar in structure to one another.

Each of the key action mechanisms 120 comprises a whippen flange 121 fixed to a center rail 115, a whippen assembly 122 turnably supported by the whippen flange 121, a jack flange 123 fixed to an intermediate portion of the whippen assembly 122, a jack 124 turnably supported by the jack flange 123, a jack spring 125 connected between the whippen assembly 122 and a toe 124*a* of the jack 124, a regulating button mechanism 126 supported by the center rail 115 and opposed to the toe 124*a* and a jack stop mechanism 127 for restricting the motion of the jack 124. The center rail 115 is supported at both ends and intermediate portions thereof by action brackets 116.

The whippen assembly 122 is held in contact with the capstan button 114, and is rotated around the whippen flange 121 by the associated black or white key 111/112 traveling from the rest position to the end position. When the key 111/112 is in the rest position, the whippen assembly 122 is substantially horizontal. The jack spring 125 urges the jack 124 in the clockwise direction, and the key 111/112 in the rest position makes the toe 124*a* spaced from the regulating button mechanism 126.

The regulating button mechanism 126 comprises a fork screw 126*a* fixed to the center rail 115, a regulating rail 126*b* connected to the fork screw 126*a*, a regulating button 126*c* connected through a regulating screw 126*d* to the regulating rail 126*b* and a regulating button felt 126*e*, and the gap between the regulating button felt 126*e* and the toe 124*a* is changeable by rotating the regulating screw 126*d*. The regulating rail 126*b* laterally extends, and the regulating buttons 126*c* share the regulating rail 126*b*.

The jack stop mechanism 127 comprises a jack stop rail 127*a* fixed to the center rail 115, a jack stop rail screw 127*b* and a jack stop felt 127*c* connected through the jack stop rail screw 127*b* to the jack stop rail 127*a*. When the key 111/112 is in the rest position, the jack stop felt 127*c* is spaced from the long portion 124*b* of the jack 124. After an escape of the jack 124, the long portion 124*b* is rearwardly moved, and rebounds on the jack stop felt 127*c*. The gap between the jack stop felt 127*c* and the long portion 124*b* is changeable by rotating the jack stop rail screw 127*b*.

The acoustic piano 100 further comprises a plurality of hammer assemblies 130 respectively driven for rotation by the key action mechanisms 120, and the hammer assemblies 130 are similar in structure to one another.

Each of the hammer assemblies 130 comprises a hammer butt 131 rotatably supported by a butt flange 117 bolted to the center rail 115, a hammer shank 132 projecting from the hammer butt 131, a hammer 133 fixed to the leading end of the hammer shank 132, a catcher 134 attached to the hammer butt 131 by means of a catcher shank 135 and a butt spring 136 urging the hammer butt 131 in the counter clockwise direction. The hammer butt 131 has a butt under felt 131*a* and a butt under cloth 131*b* fixed to the lower surface of the hammer butt 131 , and the key 111/112 in the rest position causes the jack spring 125 and the butt spring 136 to hold the leading end of the long portion 124*b* and the butt under cloth 131*b* in contact with one another.

The acoustic piano 100 further comprises a hammer rail 140 provided from the hammer assemblies 130, a hammer rail hinges 142 connected between the action brackets 116 and the hammer rail 140, a plurality of shock absorbers 142 fixed to the hammer rail 140, a plurality of back checks 143 opposed to the catchers 134, a plurality of bridle tapes 144 and a plurality of sets of strings 150 stretched along a sound board (not shown).

The plurality of shock absorbers 142 are respectively associated with the hammer assemblies 130, and a holder 142*a*N, a plunger 142*b* projectable from and retractable into the holder 142*a* and a damping member such as a rubber block provided inside of the holder 142*a* form in combination each of the shock absorbers 142. The plurality of shock absorbers 142 define respective home positions of the hammer assemblies 130.

Namely, when the black and white keys 111/112 are in the rest position, the key action mechanisms 120 rearwardly urge the associated hammer assemblies 130, and the hammer shanks 132 are held in contact with the plungers 142*b*.

If the hammer assembly 130 is driven for rotation by the key action mechanism 120, the hammer assembly 130 rushes toward the set of strings 150, and rebounds on the strings 150 or the silent mechanism 300 (which will be hereinbelow described in detail). After the rebound, the hammer assembly 130 rearwardly moves, and is brought into collision with the plunger 142*b*. The plunger 142*b* is retracted into the holder 142*a*, and the damping block in the holder 142*a* takes up the kinetic energy of the hammer assembly 130. Thus, the shock absorbers 142 prevent the hammer assemblies 130 from rebound, and maintain the hammer assemblies 130 at the home positions.

While the hammer assemblies 130 are resting in the home positions, the catchers 134 are spaced from the back checks 143. When the hammer shanks 132 are brought into collision with the plungers 142*b*, the catchers 134 are also brought into collision with the back checks 143, and rebound on the back checks 143.

The bridle tapes 144 combine the returning motions of the hammer assemblies 130 with the returning motions of the whippen assemblies 122, and prevent the sets of strings 150 from double strike with the hammer assemblies 130.

The keyboard musical instrument further comprises a plurality of damper mechanisms 160 respectively associated with the plurality of sets of strings 150. The damper mechanisms 160 are respectively driven by the black and white keys 111 and 112, and allow the sets of strings 150 to vibrate upon impacts of the hammers 133.

The damper mechanisms 160 are similar in structure to one another, and each of the damper mechanisms 160 comprises a damper lever 161 rotatably supported by a damper lever flange (not shown), a damper wire 162 upwardly projecting from the damper lever 161, a damper head fixed to the leading end of the damper wire 162, a damper spoon 164 implanted into the front end portion of the whippen assembly 122 and a damper spring 165 urging the damper lever 161 in the clockwise direction. The damper lever 161 urged by the damper spring 165 causes the damper head 163 and the lower end thereof to be held in contact with the set of strings 150 and the damper spoon 164.

While a depressed key 111/112 is rotating the whippen assembly 122 in the clockwise direction, the damper spoon 164 pushes the damper lever 161, and rotates the damper lever 161 in the counter clockwise direction. As a result, the damper head 163 is left the strings 150, and allows the strings 150 to vibrate. After the release of the key 111/112, the damper spoon 164 is left the damper lever 161, and the damper spring 165 urges the damper lever 161 in the clockwise direction. As a result, the damper head 163 is brought into contact with the strings 150 again.

As will be understood from the foregoing description, the acoustic piano 100 is analogous from a standard upright piano.

The silent system 200 is supported by the action brackets 116, and is changed between a free position FP shown in FIG. 1 and a blocking position BP shown in FIG. 2. The silent system 200 enters into the free position FP in the standard acoustic sound mode, and is changed to the blocking position BP in the electronic sound mode. The silent system 200 is maintained at either free or blocking position depending upon the recording performance.

Figure 3A:
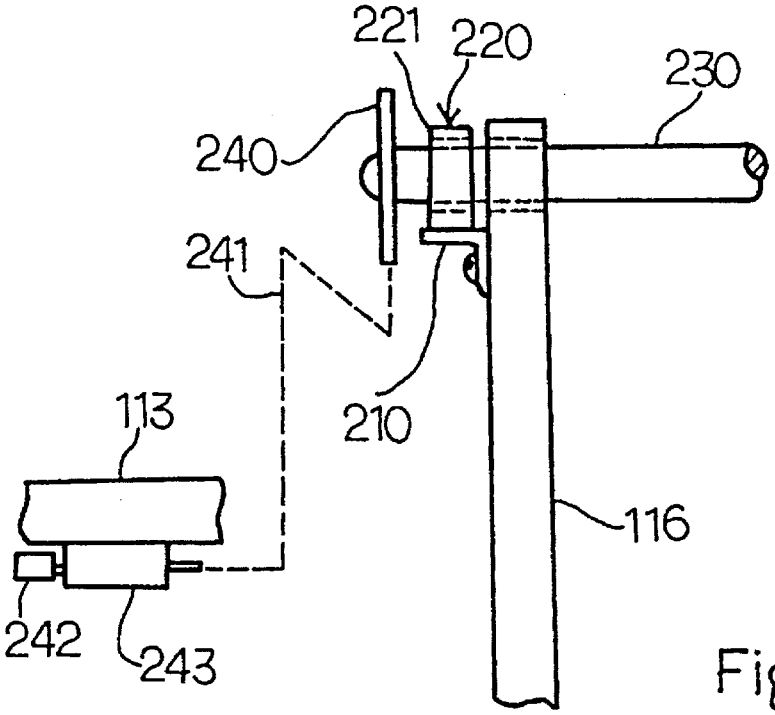
FIG. 3A is a rear view showing the structure of a silent system incorporated in the keyboard musical instrument in the acoustic sound mode or the recording mode.
Figure 3B:
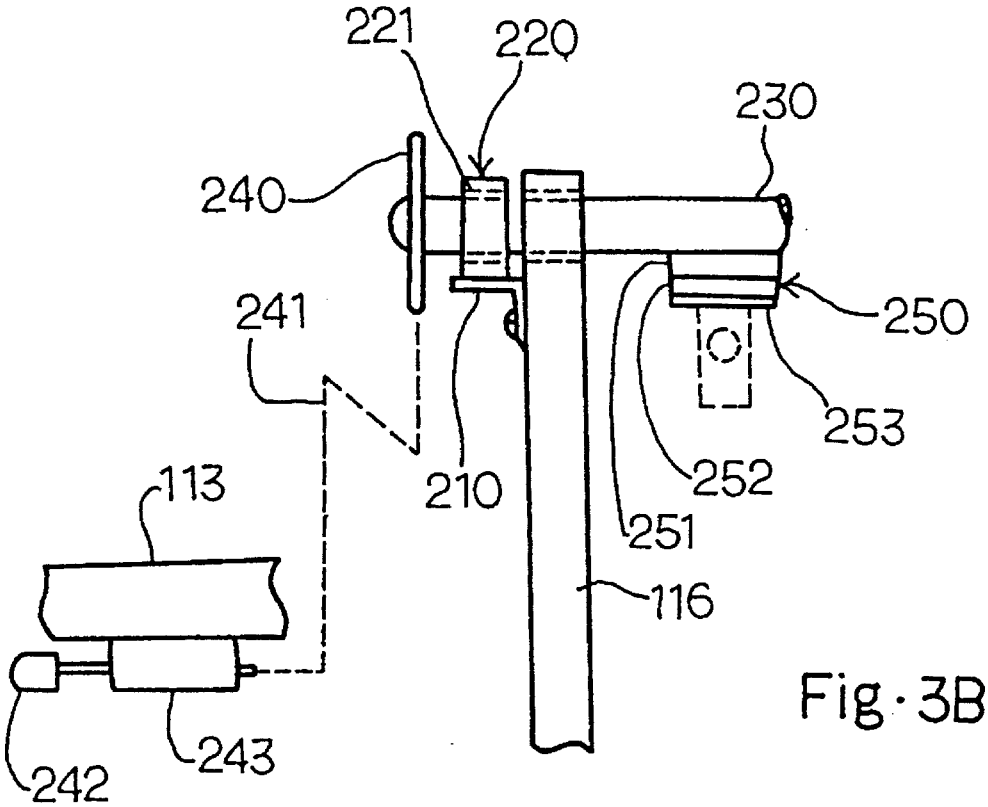
FIG. 3B is a rear view showing the structure of the silent system in the electronic sound mode.

The silent system 200 is constructed as follows. Angle members 210 are bolted to side surfaces of the action brackets 116 (see FIGS. 3A and 3B), and bearing units 220 are mounted on the angle members 210. A shaft member 230 is rotatably supported by felt members 221 of the bearing units 220, and an arm member 240 is fixed to one end portion of the shaft member 230. The shaft member 230 has a plurality of sections each located between the action brackets 116, and cushion units 250 are respectively attached to the sections of the shaft member 230.

The arm member 240 is connected through a transmission cord 241 to a grip 242. The grip 242 is slidably supported by a case 243, and the case 242 is attached to the lower surface of the key bed 113.

If a player pulls the grip 242, the shaft member 230 is driven for rotation, and the silent mechanism 200 is changed from the free position FP to the blocking position BP.

Each of the cushion units 250 comprises a cushion bracket 251 fixed to the section of the shaft member 250, a cushion sheet 252 attached to the cushion bracket 251 and a protective sheet 253 covering the cushion sheet 252. The cushion sheet 252 is, by way of example, formed of felt, and the protective sheet 253 may be formed of artificial leather.

When the silent system 200 is changed from the free position FP to the blocking position BP, the protective sheets 253 are opposed to the catchers 134. In this situation, if the jack 124 escapes from the hammer butt 131, the catcher 134 is rotated together with the hammer butt 131 in the clockwise direction, and rebounds on the cushion unit 250 before the hammer 133 strikes the strings 150.

In this instance, the shaft member 230 is rotated by means of the grip 242 provided under the key bed 113: however, a motor unit or a solenoid-operated actuator unit may be connected to the shaft member 230, and the shaft member 230 may be connected through a link mechanism to a pedal projecting from a bottom sill.

The electronic recording/sound generating system 300 comprises an array of hammer sensors 310 respectively associated with the hammer shanks 132, a change-over mechanism 320 shifting the position of the array of hammer sensors 310, a headphone 350 for a player and a controlling unit 360 connected to the hammer sensors 310 and the headphone 350.

A shutter plate 311 and a photo-detector 312 form each of the hammer sensors 310. The shutter plates 311 is generally L-shaped, and are respectively attached to the hammer shanks 132. The shutter plates 311 project toward the front side, and vertical slits 313 are respectively formed in the shutter plates 311.

Figure 4:
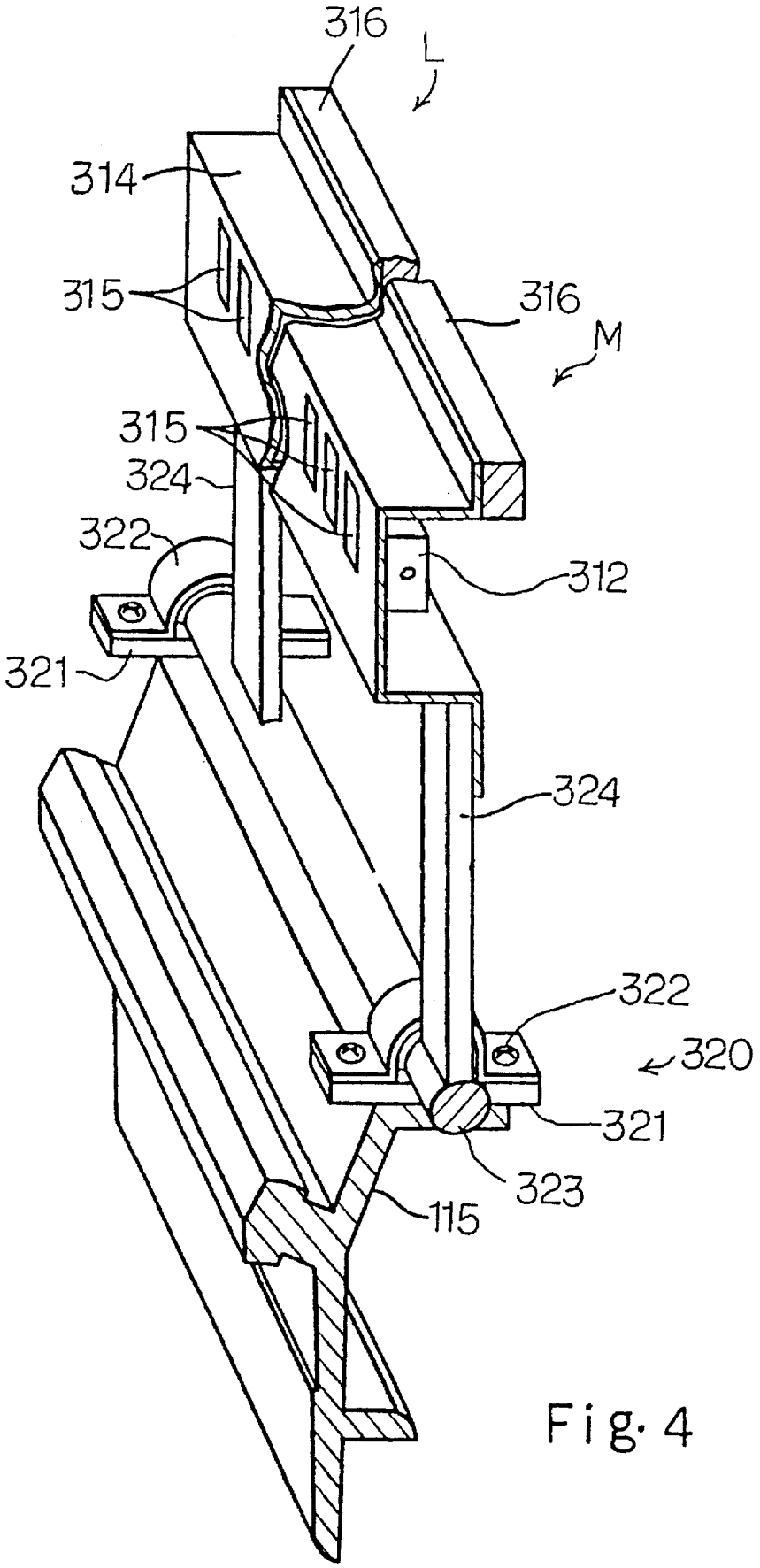
FIG. 4 is a perspective view showing a change-over mechanism incorporated in the keyboard musical instrument.

As shown in FIG. 4 of the drawings, the photo-detectors 312 are attached to a channel-shaped bracket member 314, and a plurality of slits 315 are formed in the channel-shaped bracket member 314. Cushion members 316 are attached to the upper edge of the channel-shaped bracket member 314, and take up the impacts of the damper wires 162. The plurality of slits 315 are respectively associated with the photo-detectors 312, and the shutter plates 311 are insertable into the slits 315. Through not shown in the drawings, a photo-coupler installed in the controlling unit 360 and optical fibers connected to the photo-coupler form in combination each of the photo-detector, and the optical fibers are opposed to each other across the slit 315. Therefore, the photo-detectors 312 radiate optical paths across the slits 315, and the shutter plates 311 intermittently interrupt the optical paths. Namely, while the hammer assemblies 130 are reciprocally moving, the shutter plates 311 pass through the associated slits 315, and intermittently interrupt the optical paths of the photo detectors 312. The photo-detectors 312 generates detecting signals indicative of the interruptions, and supply the detecting signals to the controlling unit 360.

Turning back to FIGS. 1 and 2, while the keyboard musical instrument is staying in the recording mode, the hammer sensors 310 detect the motions of the associated hammer assemblies 130, and report the current hammer positions varied with time. The controlling unit 360 generates a series of music data codes each containing at least a pieces of key code information, a pieces of hammer velocity information, a piece of hammer impact timing and a piece of detecting timing information on an absolute time scale. The music data codes are stored in an internal memory or an external memory such as, for example, a floppy disk, and the controlling unit 360 records the original performance in cooperation with the hammer sensors 310.

In the electronic sound generating mode, the hammer sensors 310 also detects the motions of the associated hammer assemblies 130, and report the current hammer positions varied with time as similar to the recording mode. The controlling unit 360 similarly generates a series of music data codes: however, the music data codes are sequentially supplied to a tone generator incorporated in the controlling unit 360. The tone generator forms an audio signal, and the audio signal generate electronic sounds instead of the strings 150.

The electronic recording/sound generating unit 360 may be a combination of the controlling unit disclosed in U.S. Ser. No. 08/073,092 and a suitable recording unit.

Figure 5:
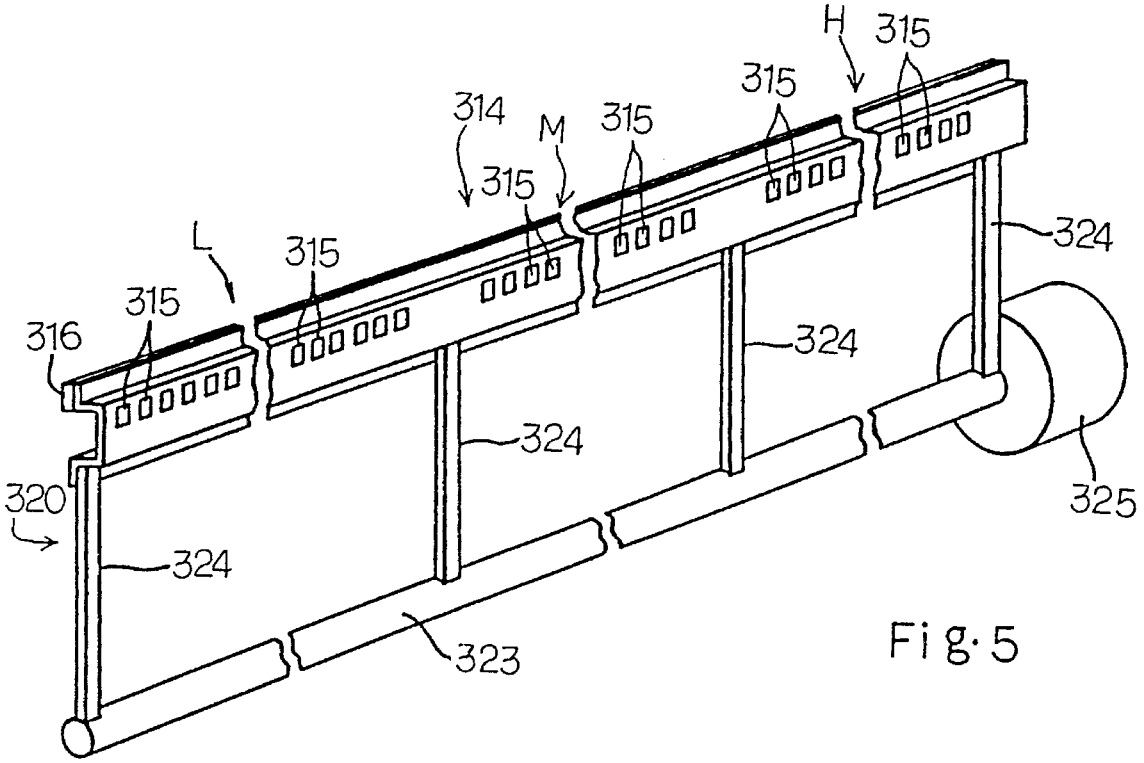
FIG. 5 is a perspective view showing the change-over mechanism from another angle.
Figure 8:
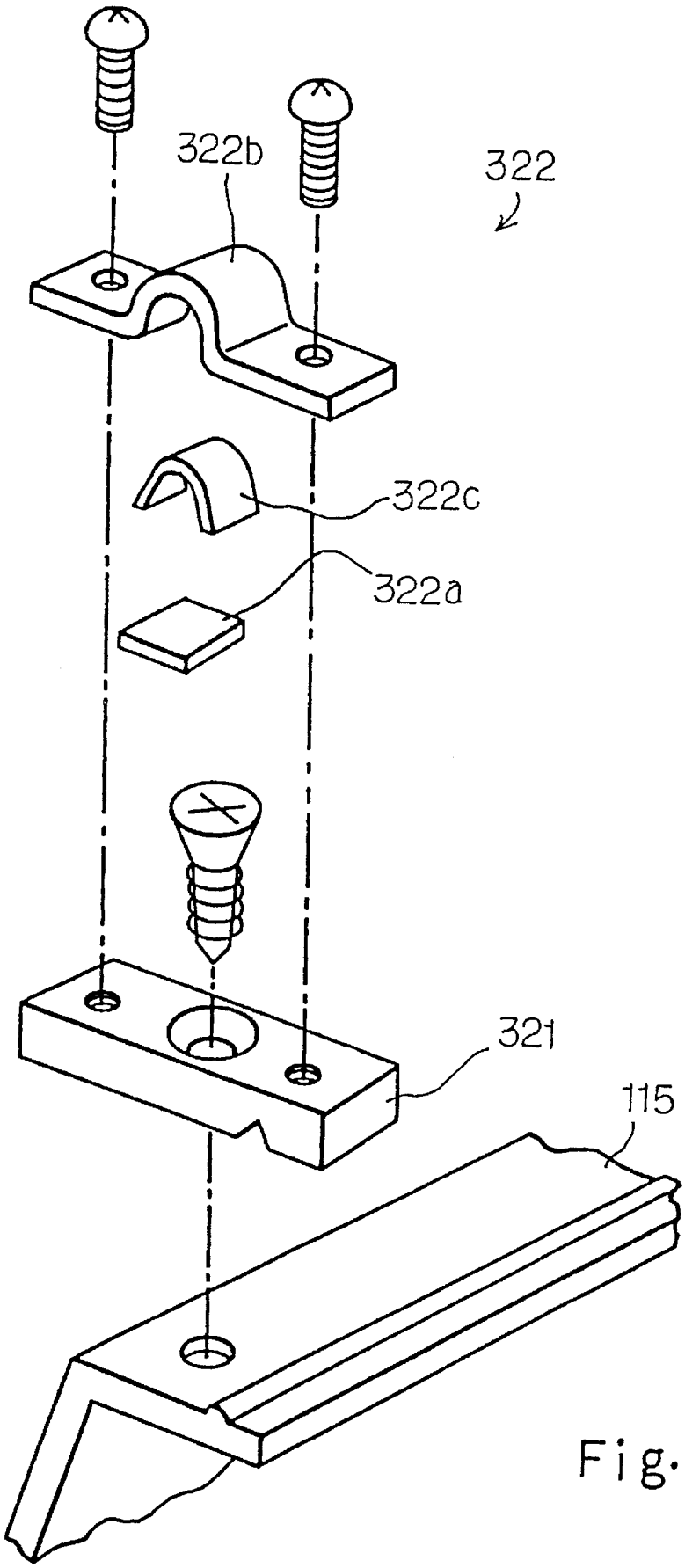
FIG. 8 is a perspective view showing parts of the bearing unit in disassembled state.

The change-over mechanism 320 comprises a plurality of plate members fixed to the upper surface of the center rail 115, a plurality of bearing units 322 bolted to the plate members 321, a shaft member 323 turnably supported by the bearing units 322, a plurality of poles 324 projecting from the shaft member 323 and supporting the channel-shaped bracket member 314 and a motor unit 325 (see FIG. 5) connected to the shaft member 323. FIG. 8 illustrates parts **322*a*, 322*b* and 322*c* of the bearing unit 322**.

The channel-shaped bracket member 314 is split into three sections H, M and L respectively associated with three groups of key action mechanisms 120 assigned high-pitched tones, middle-pitched tones and low-pitched tones, and the gaps between the sections H, M and L allows the action brackets 116 and a frame to pass therebetween.

Figure 6:
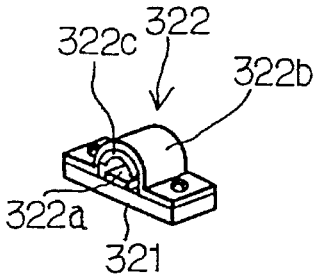
FIG. 6 is a perspective view showing a bearing unit used in the change-over mechanism.

A felt sheet **322*a* attached to the plate member 321, a cover member 322*b* bolted to the plate member 321 and a felt sheet 322*c* attached to the inner surface of the cover member 322*b* form in combination each of the bearing unit 322 as shown in FIG. 6**.

The controlling unit 360 may supply driving current to the motor unit 325 in response to a selection of the modes, and the photo-detectors 312 are changed between a closed position CL in the standard acoustic sound mode (see FIG. 1) and a spaced position SP in the silent mode (see FIG. 2).

Figure 7:
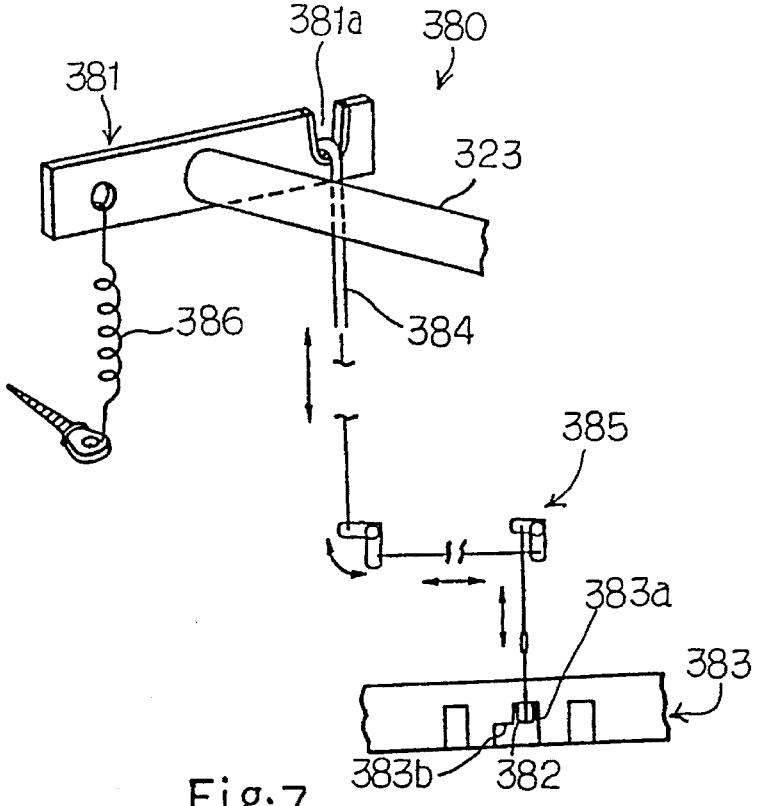
FIG. 7 is a schematic view showing a modification of the change-over mechanism.

A pedal mechanism 380 shown in FIG. 7 is available for the change-over mechanism 320 instead of the motor unit 325. The pedal mechanism 380 comprises an arm member 381 connected to the shaft member 323, a pedal 382 projecting from a bottom sill 383, a wire 384 engaged with a notch **381*a* formed in the arm member 381, a link sub-mechanism 384 connected between the pedal 382 and the wire 384 and a return spring 386. The return spring 386 urges the arm member 381 in the counter clockwise direction, and the arm member 381 upwardly pulls the pedal 382 through the link sub-mechanism 385. For this reason, the pedal 382 is held in contact with an upper step 383*a* formed in the bottom sill 383, and the hammer sensors 312 are in the closed position CL. If a player steps on the pedal 382 and laterally moves it, the pedal 382 is brought into contact with a lower step 383*b* formed in the bottom sill 383, and the link sub-mechanism 385 and the wire 384 pull down the arm member 381. The arm member 381 is rotated in the clockwise direction, and the hammer sensors 312** enter into the spaced position SP.

Description is hereinbelow made on the modes of operation, and the keyboard musical instrument is assumed to enter into the standard acoustic sound mode, thereafter, into the recording mode through the acoustic sounds and, finally, into the electronic sound mode.

When a player selects the standard acoustic mode, the player maintains the stopper 250 in the free position FP, and instructs the controlling unit 360 to hold the hammer sensors 312 in the closed position CL. While the player is performing a music on the keyboard 110, the player is assumed to depress the white key 112, and the capstan button 114 upwardly pushes the whippen assembly 122.

The whippen assemblies 122 and the jacks 124 are rotated in the clockwise direction around the whippen flanges 121, and the toe **124*a* is brought into contact with the regulating button felt 126*e*. The regulating button felt 126*e* restricts the jack 124, and the whippen assembly 122 upwardly pushed rotates the jacks 124 around the jack flange 123 against the elastic force of the jack spring 125. Then, the jack 124 escapes from the hammer butt 131, and the hammer butt 131 rotates from the home position toward the set of strings 150**.

While the whippen assembly 122 is rotating around the whippen flange 121, the damper spoon 164 pushes the damper lever 161, and rotates the damper lever 161 in the counter clockwise direction. The damper head 163 leaves the set of strings 150, and allows the set of strings 150 to vibrate.

The hammer 133 rebounds on the set of strings 150 without a contact between the catcher 134 and the back check 143, and the catcher 134 returns toward the back check 143. Upon the impact of the hammer 133 on the strings 150, the strings 150 vibrate, and generate the acoustic tone having the note assigned to the depressed white key 112.

When the player releases the white key 122, the whippen assembly 122 is rotated around the whippen flange 121 in the counter clockwise direction, and the damper head 163 is brought into contact with the set of strings 150 again. The jack 124 slides into the home position under the hummer butt 131, and the hammer assembly 130 returns to the home position. The shock absorber 142 takes up the impact of the hammer shank 132.

In the recording mode, the keys 111 and 112, the key action mechanisms 120, the hammer assembly 130 and the damper mechanism 160 behave as similar to the standard acoustic sound mode. The hammer sensor 310 associated with the depressed key 112 detects the depressed key 112 and a variation of current position of the hammer shank 132 immediately before the impact on the strings 150, and the controlling unit 360 determines the depressed key 112, the hammer impact timing, the hammer velocity and the time of the detection.

Figure 9:
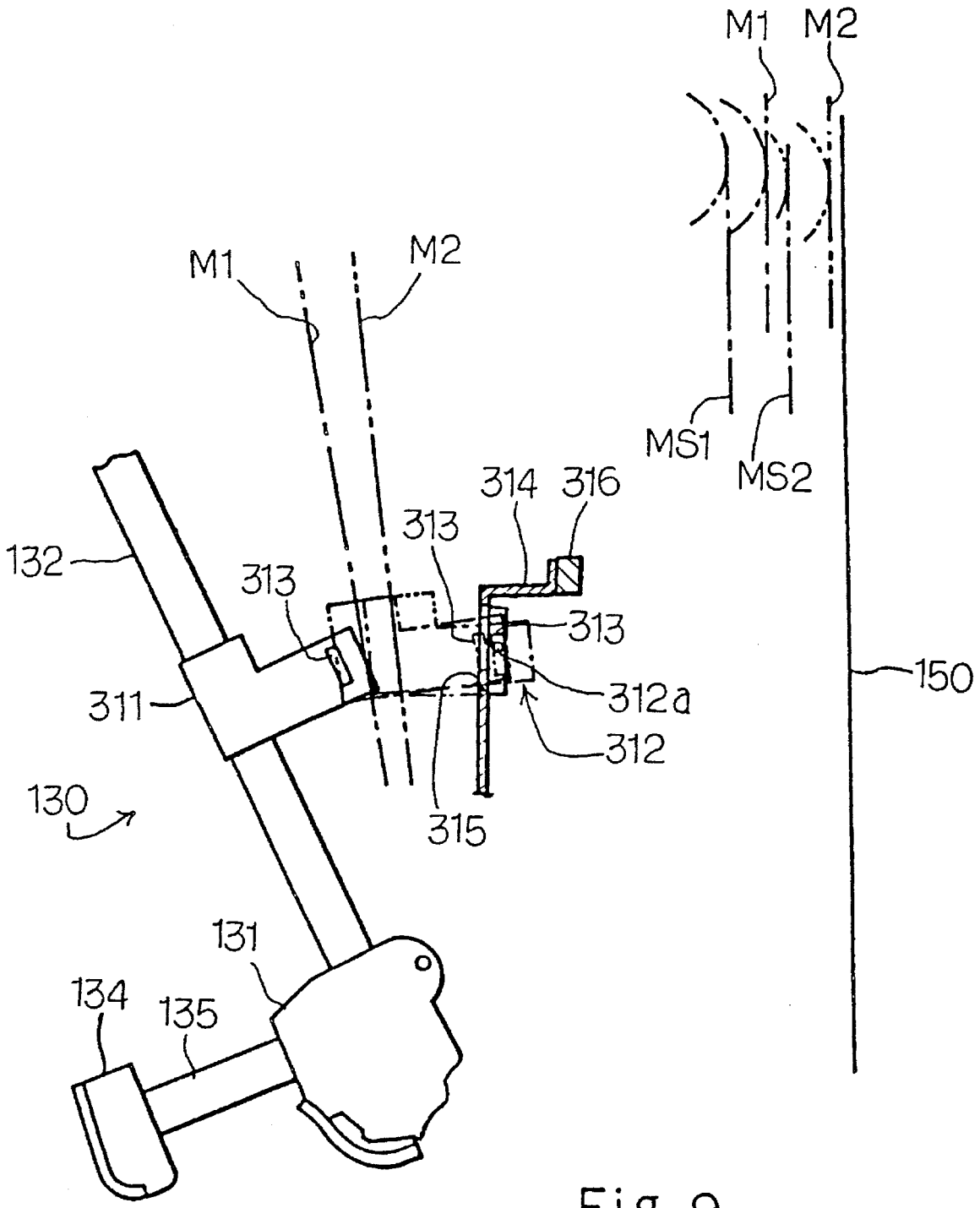
FIG. 9 is a view illustrating relation among a shutter plate, a photo detector, a hammer and strings.

FIG. 9 illustrates the relation between the hammer motion and the photo-detector 312 radiating an optical beam 312*a*, and the hammer assembly 130 at the home position is drawn by real lines. After the hammer assembly 130 starts the rotation, the shutter plate 311 proceeds toward the photo-detector 312. When the hammer assembly 130 reaches M1, the shutter plate 312 is inserted into the slit 315, and interrupts the optical beam 312*a*. The photo-detecting element supplies the hammer position signal indicative of the timing of photo-interruption. Thereafter, when the hammer assembly 130 reaches M2, the optical beam 312*a* passes through the slit 312*a*, and the photo-detecting element detects the light again. Then, the photo-detecting element supplies the detecting signal indicative of the timing of photo-detection again. The controlling unit 360 counts the time interval between the photo-interruption and the photo-detection, and decides the hammer velocity. The controlling unit 360 may count a time interval between the photo-detection and a photo-interruption at the rear edge of the slit 315.

After the hammer assembly 130 rebounds on the strings 150, the photo-detector 312 detects the photo-interruption and the photo-detection, and the controlling unit 360 determines the released key and the released timing. The controlling unit 360 generates a music data code containing the released key code information and the release timing information.

Thus, the controlling unit 360 generates a series of music data codes indicative of the performance, and stores in the internal memory. The music data codes may be supplied to another electronic musical instrument.

If a player wants to perform a music in the electronic sound mode, the player changes the stopper 250 to the blocking position BP, and the controlling unit 360 moves the photo-detectors 312 into the spaced position SP.

While the player is selectively depressing the black and white keys 111 and 112, the white key 112 is assumed to be depressed. The capstan button 114 upwardly pushes the whippen assembly 122, and the whippen assembly 122 actuates the damper mechanism 160. The damper head 163 leaves the strings 150, and gives the same load as in the standard acoustic sound mode.

The whippen assembly 122 is rotated in the clockwise direction until the toe 124*a* is brought into contact with the associate set of strings 150. However, the whippen assembly 122 is continuously rotating, and the jack spring 125 is compressed. Then, the jack 124 escapes from the hammer butt 131, and the hammer 133 and the catcher 134 is rotated in the clockwise direction.

The catcher 134 rebounds on the stopper 250 before the head 133 reaches the strings 150, and, for this reason, the strings 150 do not generate an acoustic sound. Even through the hammer assembly 130 does not reach the strings 150, the hammer action is detectable by the hammer sensor 310 in the spaced position SP. When the head 133 reaches MS1, the optical-path 312*a* is interrupted by the shutter plate 311. The photo-detector 312 detects the light again at a hammer position MS2. Thus, the hammer sensor 312 detects the hammer motion at the spaced position SP.

After the rebound on the stopper 250, the shutter plate 311 interrupts and, thereafter, receives the optical path.

The controlling unit 360 generates the music data code on the basis of the key code information, the hammer velocity information and the impact timing information and the music data code indicative of the released key code and the release time, and the music data codes are supplied to the tone generating unit.

Thus, the controlling unit 360 sequentially generates the music data codes, and the tone generating unit converts the music data codes into the audio signal AD. The tone generating unit tailors the waveform of the audio signal AD as similar to that of the acoustic piano tone, and the player can hear the performance through the headphone 350. The tone generating unit may give another timbre to the performance.

If the player wants to record the performance in the electronic sound mode, the controlling unit 360 supplies the music data codes together with the pieces of detection time information on the absolute time scale in parallel to the internal/external memory, and are stored therein.

In this instance, the gap between each position MS2 and the associated set of strings 150 is equal to the other gap, and the positions MS2 are assumed to be the impact points. If the gaps are not equal, delay may be introduced, and the amount of delay is proportional to the differences between a reference gap and the actual gaps.

As will be appreciated from the foregoing description, the change-over mechanism 320 changes the photo-detectors 312 between the closed position CL and the spaced position SP, and the hammer sensors 312 can exactly detect the hammer motion at both positions CL and SP. The electronic sounds and the reproduced acoustic sounds are faithful to player's intention, because the hammer sensors 312 directly detect the motions of hammers 130. Since the hammer sensors 312 are shared between the recording mode and the electronic sound mode, the keyboard musical instrument is simple in structure and highly reliable.

SECOND EMBODIMENT

Figure 10:
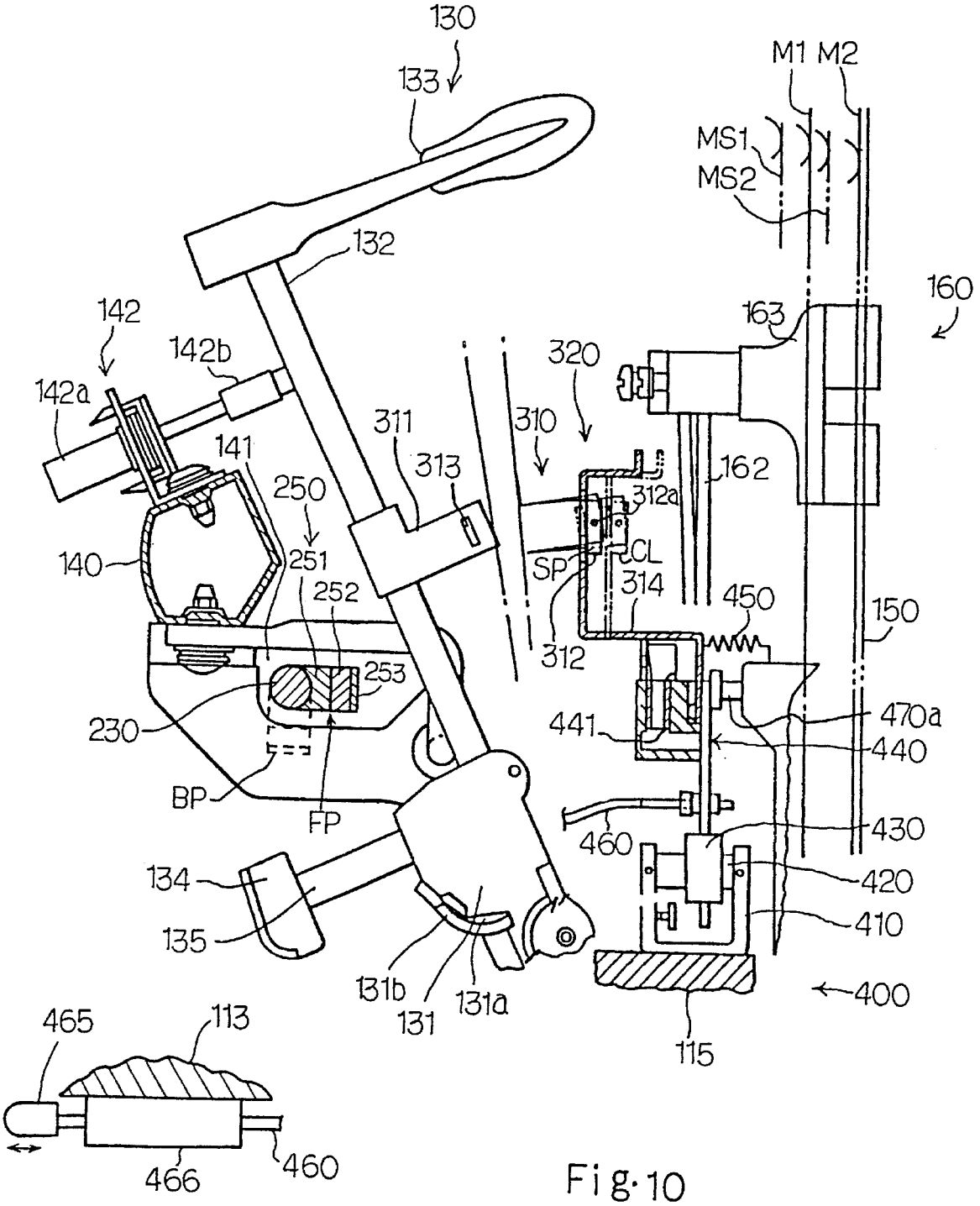
FIG. 10 is a side view showing essential parts of another keyboard musical instrument according to the present invention.

Turning to FIG. 10 of the drawings, a change-over mechanism 400 is incorporated in another keyboard musical instrument embodying the present invention. The keyboard musical instrument implementing the second embodiment is similar to the first embodiment except for the change-over mechanism 400, and the other parts are labeled with the same references designating corresponding parts of the first embodiment.

The change-over mechanism 400 comprises a channel-shaped bracket member 410 fixed to the center rail 115, a plurality of guide members 420 fixed to the channel-shaped bracket member 410 in the fore-and-aft direction of the keyboard musical instrument and a slider 430 slidably supported by the guide members 420 and a frame structure 440 connected between the slider 430 and the channel-shaped bracket member 314. A tube member 441 is attached to the frame structure 440, and the optical fibers of the photo-detectors 312 pass through the tube member 441.

The change-over mechanism 400 further comprises a spring 450 and a flexible wire 460 connected to a grip 465. The channel-shaped bracket member 314 is urged by a spring 450 toward the strings 150, and the frame structure 440 is held in contact with a stopper 470*a*. The stopper 470*a* defines the closed position CL of the photo-detectors 312, and the spring 450 maintains the photo-detectors 312 at the closed position CL.

On the other hand, the grip 465 is slidably supported by a case 466 attached to a lower surface of the key bed 113, and pulls the slider 430 against the elastic force of the spring 450. The slider 430 is moved toward the front side, and the photo-sensors 312 enter into the spaced position SP. Though not shown in FIG. 10, the grip 465 is accompanied with a locking unit, and the locking unit maintains the grip 465 at a projected position.

The keyboard musical instrument shown in FIG. 10 also selectively enters into the modes of operation, and the change-over mechanism 400 allows the photo-detectors 312 to exactly detect the photo-interruption and the photo-detection in both electronic sound and recording modes of operation.

THIRD EMBODIMENT

Figure 11:
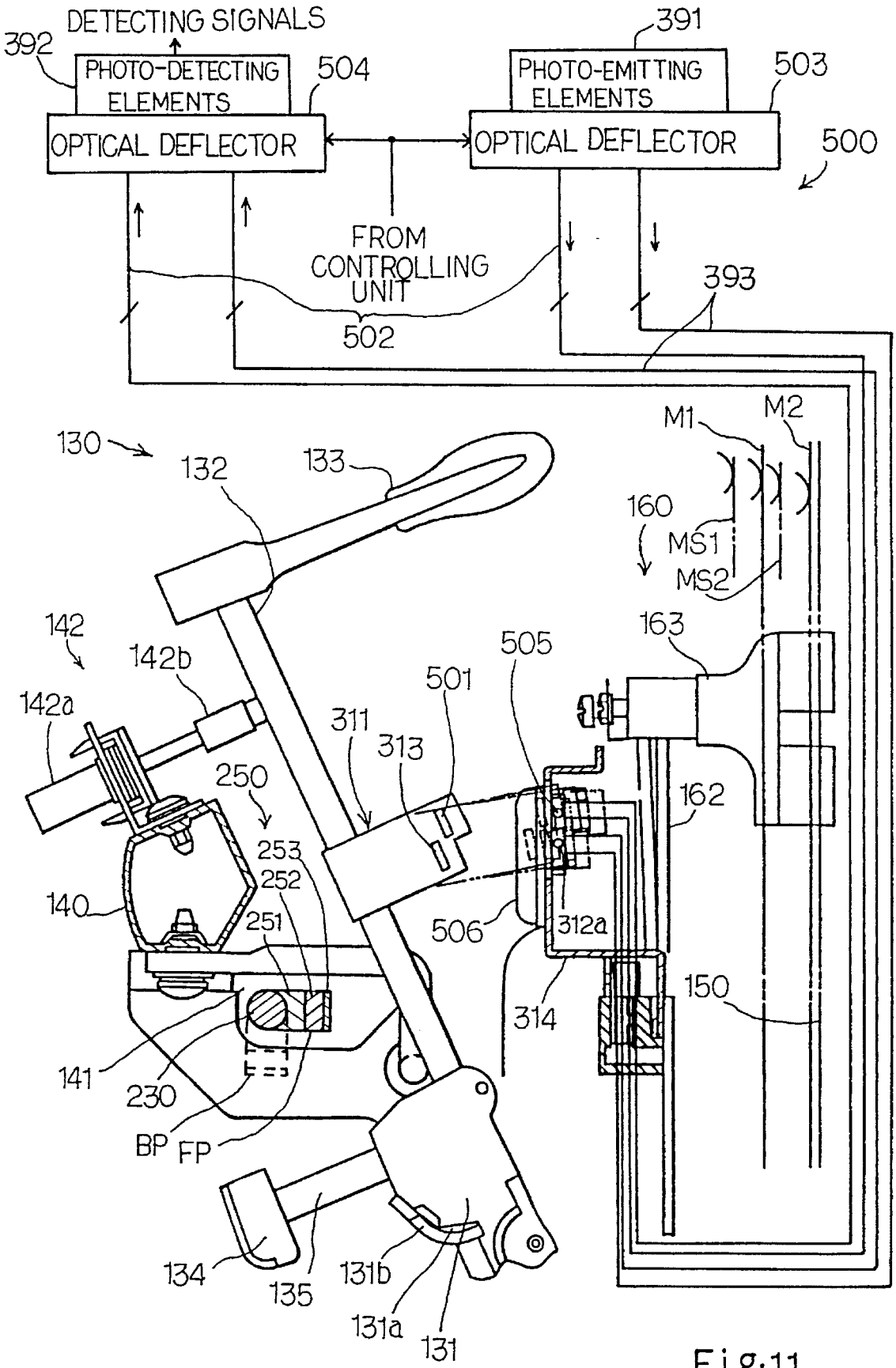
FIG. 11 is a side view showing essential parts of yet another keyboard musical instrument according to the present invention.

FIG. 11 illustrates essential parts of yet another keyboard musical instrument embodying the present invention. The keyboard musical instrument implementing the third embodiment is similar to the first embodiment except for a change-over mechanism 500, and parts and members corresponding to those of the first embodiment are labeled with the same references used in FIGS. 1 and 2 without detailed description.

The change-over mechanism 500 comprises second slits 501 formed in the shutter plates 311 together with the slits 313, second pairs of optical fibers 502, a first optical deflector 503 associated with the photo-emitting elements 391 and a second optical deflector 504 associated with photo-detecting elements 392.

The first pairs of optical fibers 393 form the first optical paths 312*a* as similar to the first embodiment, and are connected between the first ports of the first optical deflector 503 and the first ports of the second optical deflector 504. On the other hand, the second pairs of optical fibers 502 are connected between the second ports of the first optical deflector 503 and the second ports of the second optical deflector 504, and form second optical paths 505 in parallel to the first optical paths 312*a*.

The first and second optical deflectors 503 and 504 are an electrooptic type, and are responsive to a control signal supplied from the controlling unit 360 so as to connect the photo-emitting elements 391 through one of the first pairs of optical fibers 393 and the second pairs of optical fibers 502 to the photo-detecting elements 392. A mechanical optical deflector is available for the first and second optical deflectors 503 and 504.

The channel-shaped bracket member 314 is fixed to the action brackets by means of fastening units 506, and is stationary with respect to the action brackets.

In this instance, while the first and second optical deflectors 503 and 504 are connecting the photo-detecting elements 391 through the first pairs of optical fibers 393 to the photo-detecting elements 392, the change-over mechanism 500 takes the closed position, because the shutter plate 311 interrupts the first optical paths 312*a* at a closer position MS2 of the hammer head 133 to the strings 150.

On the other hand, if the first and second optical deflectors 503 and 504 connects the photo-emitting elements 391 through the second pairs of optical fibers 502 to the photo-detecting elements 392, the change-over mechanism 500 enters into the spaced position, and the shutter plate 311 interrupts the second optical path 505 at a position MS1 earlier than the closed position. The photo-detecting elements 392 receive the light passing through the slits 501 after the interruption.

If two sets of photo-emitting/photo-detecting elements 391/392 are respectively provided for the first pairs of optical fibers 393 and the second pairs of optical fibers 502, the optical deflectors 503 and 504 are deleted from the change-over mechanism 500, and the controlling unit 360 selects the detecting signals of the first set of photo-emitting/photo-detecting elements or the detecting signals of the second set of photo-emitting/photo-detecting elements.

The keyboard musical instrument implementing the third embodiment is simple in mechanical structure, and decreases the production cost and the maintenance cost. The third embodiment achieves all of the advantages of the first embodiment.

FOURTH EMBODIMENT

Figure 12:
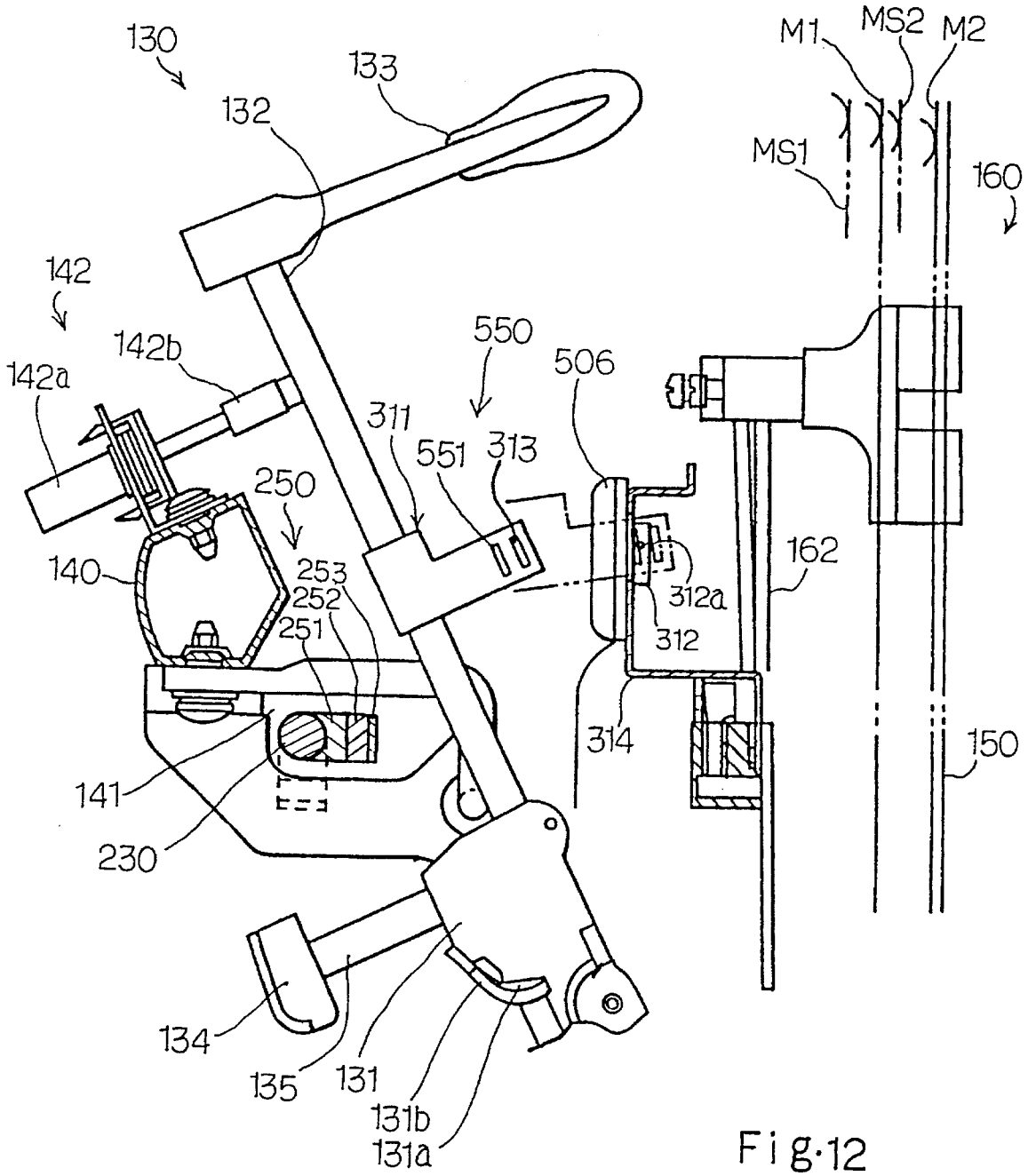
FIG. 12 is a side view showing essential parts of still another keyboard musical instrument according to the present invention.

FIG. 12 illustrates still another keyboard musical instrument embodying the present invention, and parts and members of the fourth embodiment are labeled with the same references designating the corresponding parts and members of the first to third embodiments without detailed description.

The channel-shaped bracket member 314 is also fixed to the action brackets by means of the fastening units 506, and is, accordingly, stationary with respect to the action brackets.

The change-over mechanism 550 comprises a slit 551 formed in the shutter plate 311 at the back of the slit 313 and an appropriate software executed by the controlling unit 360, and the photo-detectors 312 are shared between the slits 312 and 551.

The controlling unit 360 discriminates the photo-interruption and photo-detection depending upon the mode of operation as follows.

While the keyboard musical instrument is in the acoustic sound mode, the leading edge of the shutter plate 311 interrupts the optical path 312*a*, and the slit 313 allows the optical path to pass therethrough. The controlling unit 360 calculates the hammer velocity on the basis of the lapse of time between the photo-interruption and the photo-detection, and determines the hammer impact timing on the basis of the photo-detection. Although the optical path 312*a* is further interrupted by an intermediate portion between the slits 313 and 551 and detected through the slit 551 again, the controlling unit 360 ignores the second photo-interruption and the second photo-detection.

On the other hand, the controlling unit 312 ignores the first photo-interruption and the first photo-detection, and calculates the hammer velocity on the basis of a lapse of time between the second interruption and the second photo-detection. The controlling unit 312 determines the hammer impact timing on the basis of the second photo-detection.

The change-over mechanism 550 is simpler than the change-over mechanism 500, and decreases the production cost and the maintenance cost of the keyboard musical instrument. The fourth embodiment achieves all of the advantages of the first embodiment.

FIFTH EMBODIMENT

Figure 13:
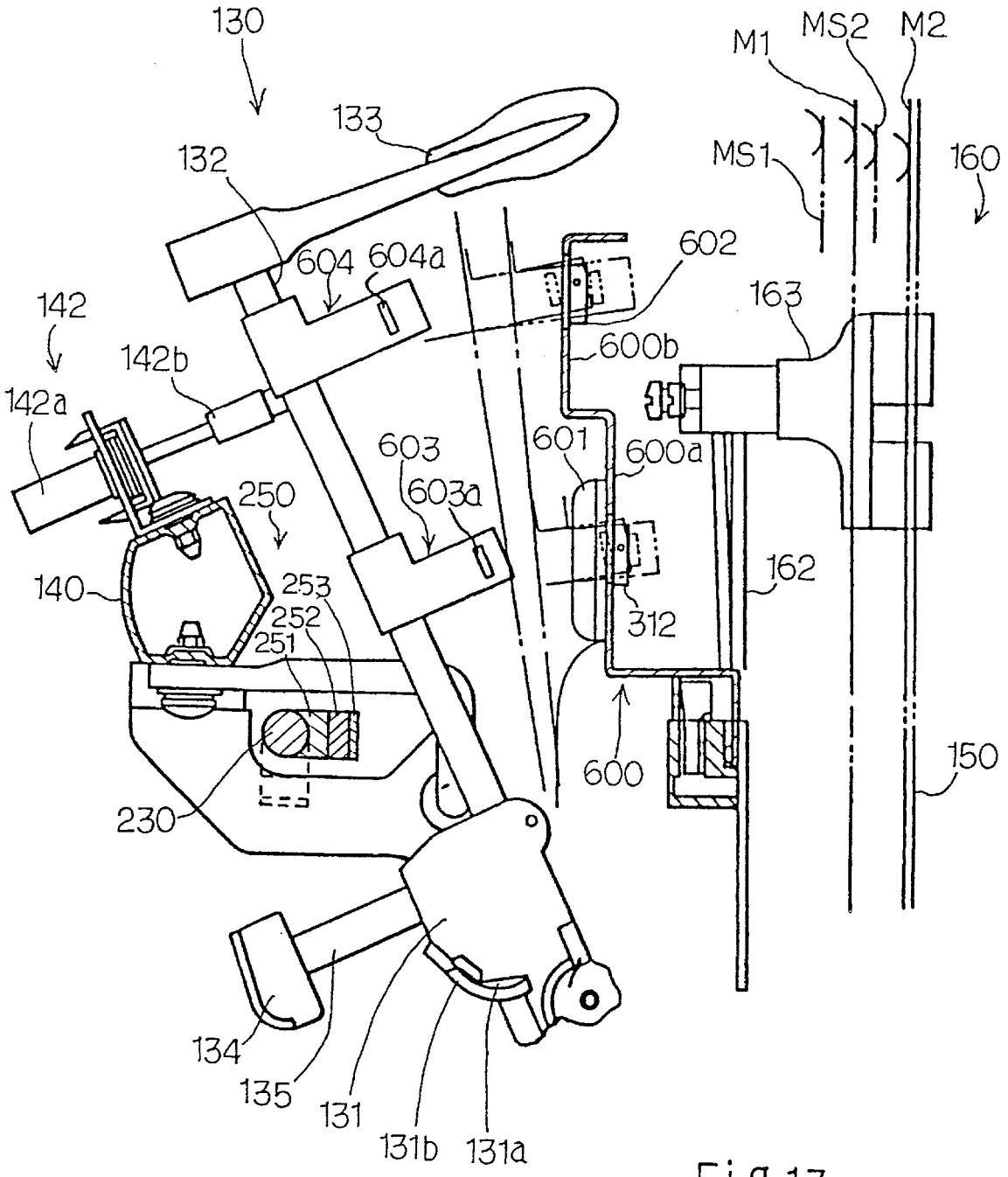
FIG. 13 is a side view showing essential parts of a keyboard musical instrument according to the present invention.

FIG. 13 illustrates a keyboard musical instrument embodying the present invention, and parts and members of the fifth embodiment are labeled with the same references designating the corresponding parts and members of the first to fourth embodiment without detailed description.

A bracket member 600 is fixed to the action brackets by means of the fastening units 601, and is, accordingly, stationary with respect to the action brackets. The bracket member 600 has a retracted portion 600*a* close to the strings 150 and a projecting portion 600*b* spaced from the strings 150, and the photo-detectors 312 are fixed to the retracted portion 600*a*. Another set of photo-detectors 602 are fixed to the projecting portion 600*b* of the bracket member 600.

A row of lower slits are formed in the retracted portion 600*a*, and first shutter plates 603 are respectively attached to lower portions of the hammer shanks 132. Slits 603*a* are respectively formed in the first shutter plates 603. When the hammer assemblies 130 are driven for rotation in the acoustic sound mode, the first shutter plates 603 respectively pass through the lower slits, and interrupt the optical paths of the photo-detectors 312 at MS2. Thereafter, the slits 603*a* allow the light radiated from the photo-detectors 312 to pass therethrough at M2. Thus, the photo-detectors 312 monitor the motions of the hammer assemblies by means of the first shutter plates 603.

A row of upper slits are further formed in the projecting portion 600*b*, and second shutter plates 604 are respectively attached to upper portions of the hammer shanks 132. When the hammer assemblies 130 are driven for rotation in the electronic sound mode, the second shutter plates 604 respectively pass through the upper slits, and interrupt the light radiated from the photo-detectors 602 at MS1. The slits 604*a* allows the light radiated from the photo-detectors 602 to pass therethrough at M1, and the photo-detectors 602 respectively monitor the motions of the hammer assemblies 130 by means of the second shutter plates 604.

The photo-detectors 312 and the photo-detectors 602 may be arranged as similar to those shown in FIG. 11.

The photo-detectors 312 and the photo-detectors 602 are independently regulated, and the fifth embodiment achieves all of the advantages of the first embodiment.

SIXTH EMBODIMENT

Figure 14:
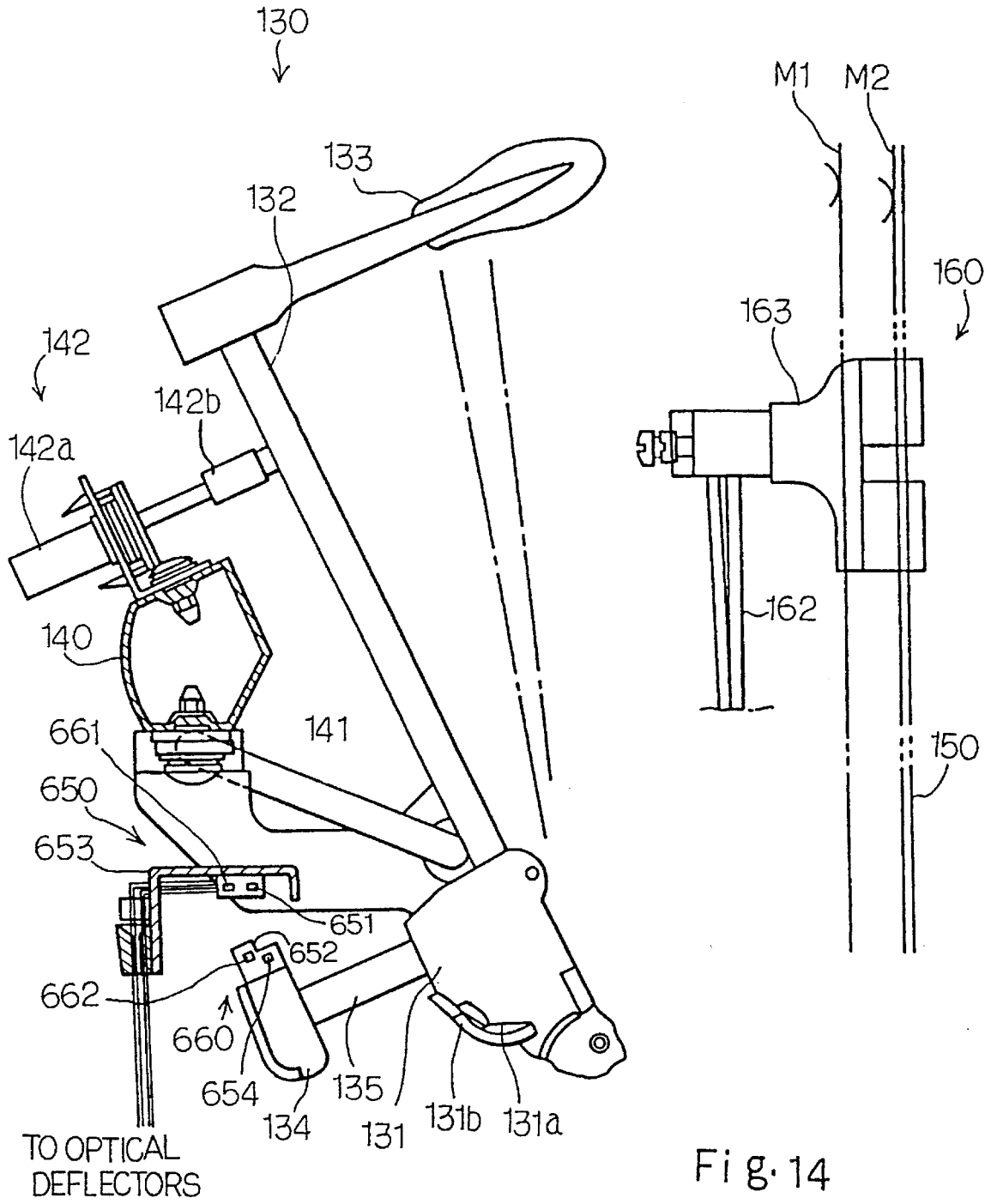
FIG. 14 is a side view showing essential parts of a keyboard musical instrument according to the present invention.

FIG. 14 illustrates a keyboard musical instrument embodying the present invention. The keyboard musical instrument implementing the sixth embodiment is similar to the first embodiment except for the position of hammer sensors 650 and a change-over mechanism 660. The other parts and component members are designated by the same references as corresponding parts and component members of the first to fifth embodiments without detailed description. The stopper 250 is deleted from FIG. 14 for the sake of simplicity.

The hammer sensors 650 are similar to the hammer sensors 312/313, and a photo-emitting element, a first optical fiber 651, a photo-detecting element and the right portion of a shutter plate 652 form in combination each of the hammer sensors 650. The optical fibers 651 are supported by a bracket member 653 which in tern is supported by the hammer rail 140. On the other hand, the shutter plate 652 is fixed to the catcher 134, and is rotatable together with the hammer assembly 130. The right portion of the shutter plate 652 interrupts an optical path between a gap formed in the first optical fiber 651, and, thereafter, allows the optical path to pass through a slit 654.

The change-over mechanism 660 comprises a plurality of second optical fibers 661 supported by the bracket member 653, the left portions of the shutter plates 652, a first optical deflector (not shown) provided between the photo-emitting elements and the first and second optical fibers 651 and 661 and a second optical deflector (not shown) provided between the photo-detecting elements and the first and second optical fibers 651 and 661.

The optical deflectors are responsive to an electric shift signal supplied from the controlling unit 360, and connect the photo-emitting elements and the photo-detecting elements to the first optical fibers 651 or the second optical fibers 661.

While the hammer assembly 130 is rotating toward the strings 150, the left portion of the shutter plate 652 interrupts an optical path between a gap formed in the second optical fiber 661, and, thereafter, allows the optical path to pass through a slit 662. However, the photo-interruption of the left portion and the photo-detection through the slit 662 are later than the photo-interruption of the right portion and the photo-detection through the slit 654.

Modifications of Silent System

Figure 15:
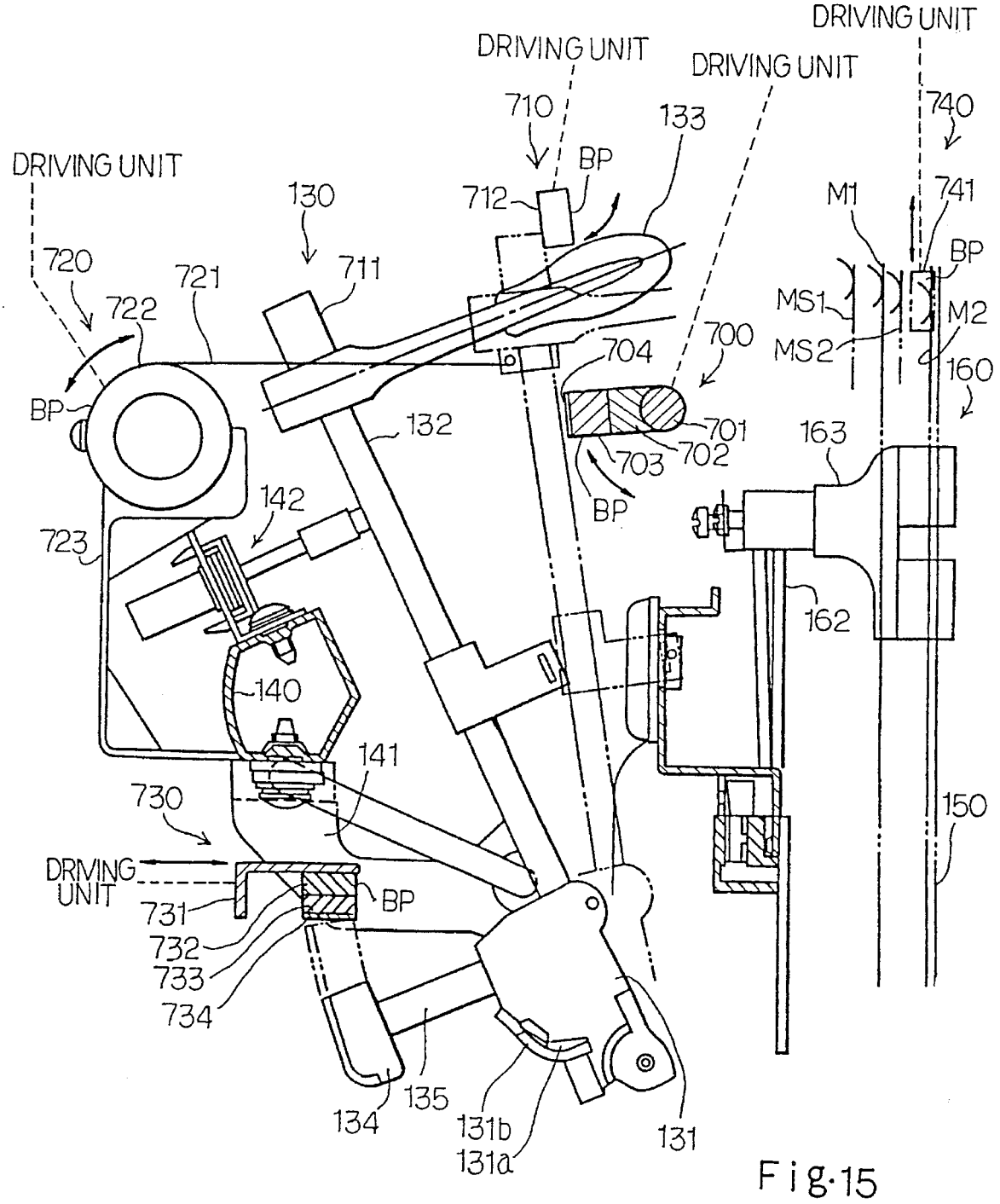
FIG. 15 is a side view showing various modification of a silent system incorporated in the keyboard musical instrument.

The silent system 200 has various modifications, and is replaceable with one of the modifications shown in FIG. 15.

The first modification of the silent system is designated by reference numeral 700, and comprises a rotatable shaft member 701, cushion brackets 702 fixed to the rotatable shaft member 701, cushion members 703 attached to the cushion brackets 702, respectively, and protective sheets 704 covering the cushion members 703. Though not shown in FIG. 15, the rotatable shaft member 701 is connected to a motor unit, a solenoid-operated actuator unit or a suitable link mechanism, and changes the cushion brackets/cushion members/cover sheets 702, 703 and 704 between the free position and the blocking position through an angular motion.

The second modification is designated by reference numeral 710, and comprises extensions 711 respectively fixed to the leading ends of the hammer shanks 132 and stoppers 712. The stoppers 712 are also connected to a motor unit, a solenoid-operated actuator unit or a suitable link mechanism, and is swung between the free position and the blocking position.

Reference numeral 720 designates the third modification. Flexible strings 721, pulleys 722 and a suitable driving unit (not shown) form the third modification. The flexible strings 721 are connected between the hammer shanks 132 and the pulleys 722, and the pulleys 722 are rotatably supported by a bracket member 723 fixed to the hammer rail 140. The strings 721 restrict the angular motions of the hammer assemblies 130, and the driving unit such as a motor unit, a solenoid-operated actuator unit or a link mechanism changes the angular positions of the pulleys 722. The pulleys 722 are in the blocking position, and the strings 721 cause the hammer assemblies 130 to return before an impact on the strings 150. If the driving unit rotates the pulleys 722 in the clockwise direction, the strings 721 allow the hammer heads 133 to rebound on the strings 150.

The fourth modification is labeled with reference numeral 730, and comprises a slidable bracket member 731, cushion brackets 732 fixed to the slidable bracket member 731, cushion members 733 attached to the cushion brackets 732 and protective sheets 734 covering the cushion members 733. The slidable bracket member 731 is connected to a suitable driving unit such as, for example, a motor unit, a solenoid-operated actuator unit or a link mechanism, and the driving unit changes the cushion brackets/cushion members/protective sheets 732 to 734 between the free position and the blocking position. The catchers 134 rebound on the protective sheets 734 in the blocking position BP before the hammer heads 133 impact on the strings 150. However, the catchers 134 do not reach the protective sheets 734 in the free position.

The fifth modification is labeled with 740, and is implemented by cushion members 741. The cushion members 741 are supported by a rigid bracket member (not shown), and a driving unit (not shown) changes the cushion members 741 between the free position outside of rotating paths of the hammer heads 133 and the blocking position BP inside of the rotating paths. The cushion members 741 in the free position allow the hammer heads 133 to strike the strings 150. However, the hammer heads 133 rebound on the cushion members 741 in the blocking position, and the cushion members 741 prevent the strings 150 from the hammer heads 133.

SEVENTH EMBODIMENT

Figure 16A:
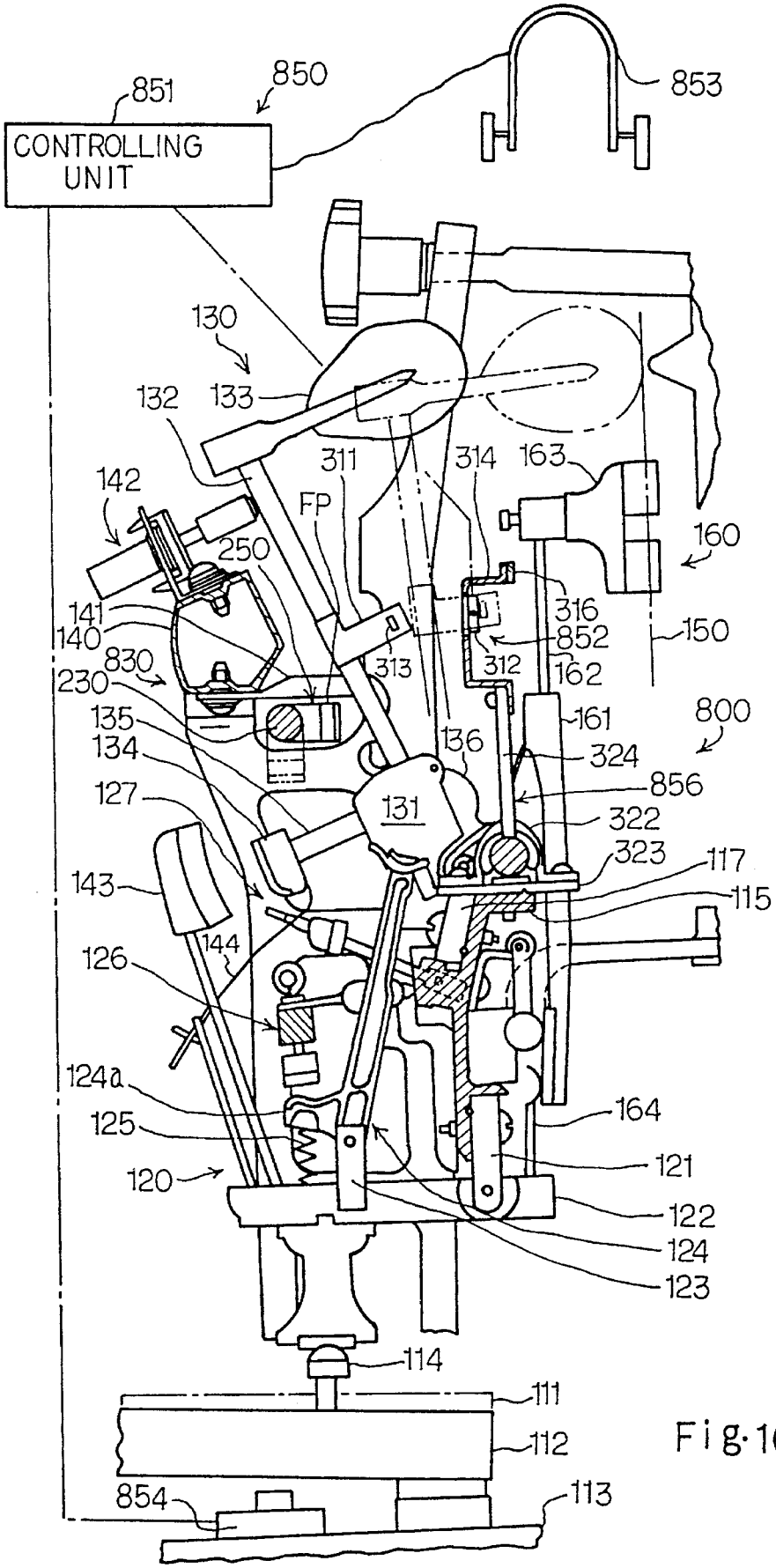
FIG. 16A is a side view showing essential parts of a keyboard musical instrument according to the present invention.
Figure 16B:
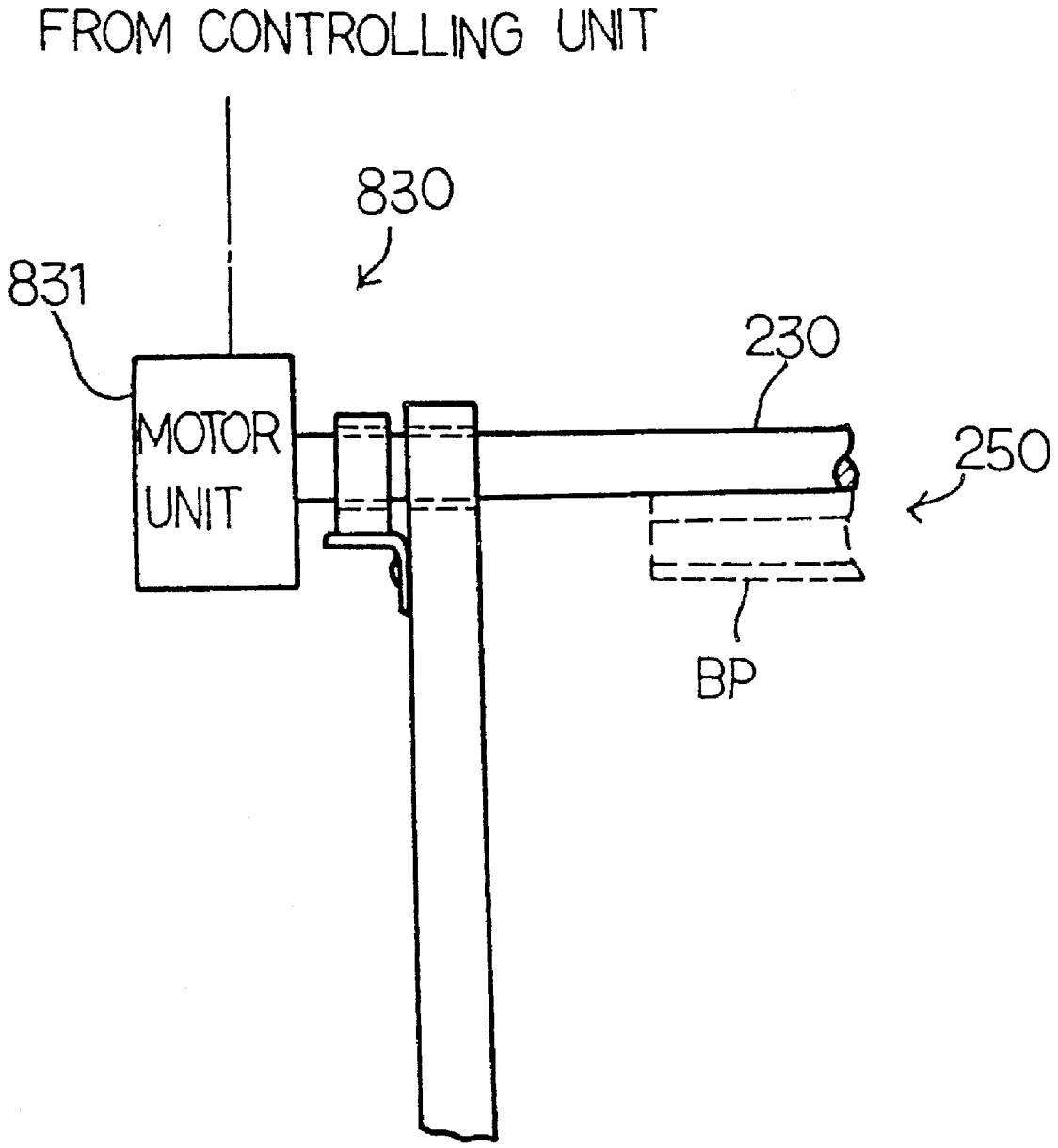
FIG. 16B is a rear view showing a part of a silent system incorporated in the keyboard musical instrument.

Turning to FIGS. 16A and 16B of the drawings, another keyboard musical instrument embodying the present invention largely comprises an acoustic piano 800, a silent system 830 and an electronic system 850, and has at least the standard acoustic sound mode, the recording mode, the electronic sound mode and a playback mode. The electronic system 850 records a performance in any one of the standard mode and the electronic sound mode, and the playback is carried out with the acoustic sounds or the electronic sounds.

Although the acoustic piano 800 and the silent system 830 are analogous from the acoustic piano 100 and the silent system 200 forming parts of the first embodiment, it is possible to replace the acoustic piano 800 and the silent system 830 with any one of the acoustic pianos of the second to sixth embodiments and any one of the silent system of the second to sixth embodiments and the first to fifth modifications described hereinbefore.

Component parts of the acoustic piano 800 and the silent system 830 are labeled with the same references designating corresponding component parts of the acoustic piano 100 and the silent system 200, and detailed description is omitted for avoiding repetition.

Although the grip 242 and the link mechanism 241 change the stopper unit 250 between the free position FP and the blocking position BP in the first embodiment, an electric motor unit 831 is connected to the shaft member 230 of the silent system 830, and a controlling unit 851 of the electronic system 850 supplies current so as to rotate in one of the two directions.

Figure 17:
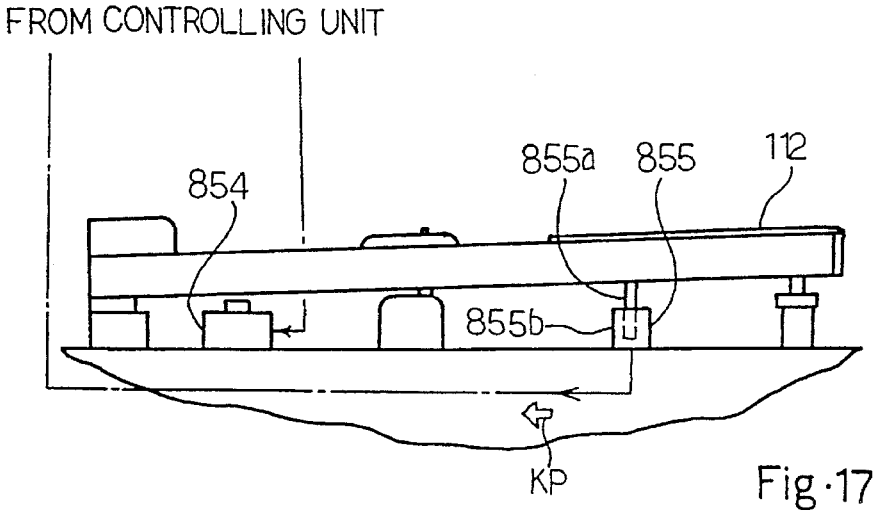
FIG. 17 is a side view showing a white key of an acoustic piano incorporated in the keyboard musical instrument.

The electronic system 850 comprises the controlling unit 851, a plurality of hammer sensors 852, a headphone 853, a plurality of solenoid-operated actuator units 854 respectively provided under the black and white keys 111/112, a plurality of key sensors 855 associated with the black and white keys 111/112 (see FIG.17) and a change-over mechanism 856. The hammer sensors 852, the headphone 853 and the change-over mechanism 856 are similar to those of the first embodiment, and component parts are labeled with the same references.

The plurality of solenoid-operated actuator units 854 push up the black and white keys 111 and 112 instead of a player, and the controlling unit 851 selectively supplies driving current to the solenoid-operated actuator units 340.

A shutter plate 855*a* and upper and lower photo-interrupters 855*b* form in combination each of the key sensors 855, and the upper photo-interrupter is vertically spaced from the lower photo-interrupter by a predetermined distance. When the key 112 is depressed, the shutter plate 855*a* successively interrupts the upper photo-interrupter and the lower photo-interrupter. On the other hand, when the key 112 is released, the lower photo-interrupter and the upper photo-interrupter are sequentially changed to the photo-detecting state. The upper and lower photo-interrupters supply a key position signal KP indicative of the current key position to the controlling unit 851.

Figure 18:
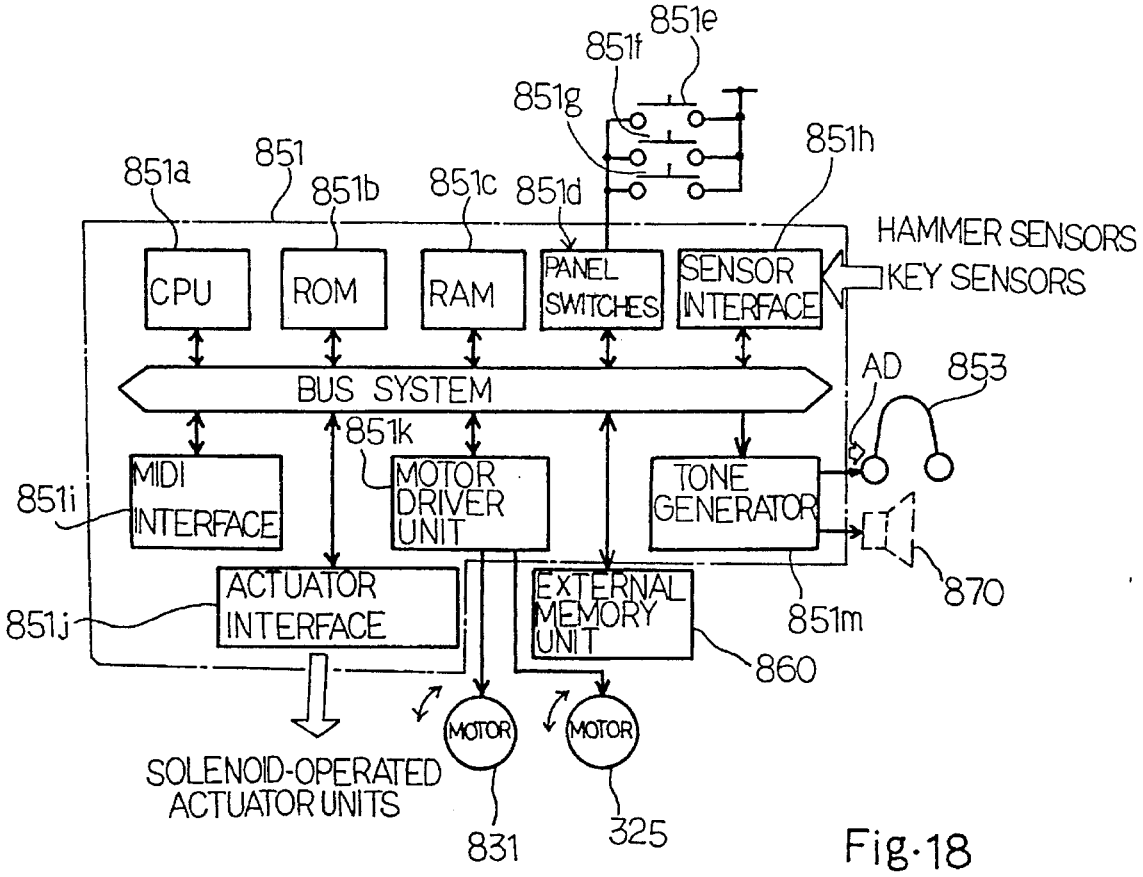
FIG. 18 is a block diagram showing the arrangement of a controlling unit incorporated in the keyboard musical instrument.

FIG. 18 illustrates the arrangement of the controlling unit 851, and determines an impact timing and a hammer velocity on the basis of a change between the photo-detecting state and the photo-interrupting state of the hammer sensors 852 in the recording mode as similar to the first embodiment. The controlling unit 851 is further operative to determine the amount of driving current selectively supplied to the solenoid-operated actuator units in the playback mode.

The controlling unit 851 comprises a central processing unit 851*a* for executing program sequences described hereinbelow, a read only memory unit 851*b* for storing the instruction codes of the program sequences, a random access memory unit 851*c* for storing data codes and panel switches 851*d* manipulative by a player, and a silent switch 851*e*, a recording switch 851*f* and a playback switch 851*g* are incorporated in the panel switches 851*d*.

When the player shifts the silent switch 851*e* to the electronic sound mode, the stopper unit 250 is changed from the free position FP to the blocking position BP, and the photo-detectors 312 are changed from the closed position CL to the spaced position SP. On the other hand, if the player shifts the silent switch 851*e* to the acoustic sound mode, the stopper unit 250 enters into the free position, and the photo-detectors 312 return to the closed position CL.

When the recording switch 851*f* is manipulated, the central processing unit 851*a* executes a recording program sequence for recording a performance.

The playback switch 851*g* causes the central processing unit 851*a* to execute a playback program sequence for reproducing the original performance.

One of the other switches 851*d* is assigned to an instruction for direct output to another musical instrument, and the music data codes are supplied to the musical instrument. The instructions given through the switches 851*d*, 851*e*, 851*f* and 851*g* are stored in internal registers of the central processing unit 851*a*. Another panel switch 851*d* is assigned to an instruction of tempo in the playback mode.

The controlling unit 851 further comprises a sensor interface 851*h* connected to the hammer sensors 852 and the key sensors 855. While the central processing unit 851*a* is executing the instruction codes of the recording program, the hammer sensors 852 and the key sensors 855 are sequentially scanned through the sensor interface 851*h* by the central processing unit 851*a*, and the central processing unit 851*a* produces a series of music data codes.

If the player depresses the white key 112 in the performance, the central processing unit 851*a* discriminates the depressed white key 112, and determines the key code assigned to the depressed white key 112. The central processing unit 851*a* calculates the hammer velocity on the basis of a lapse of time between the photo-interruption and the photo-detection, and determines the impact timing at the photo-detection through the slit 313. When the impact timing is determined, the central processing unit 851*a* produces the music data code containing a piece of key-on information or the impact timing and a piece of hammer velocity information.

When the player releases the depressed white key 112, the white key 112 returns toward the rest position, and the lower photo-interrupter and the upper photo-interrupter are sequentially changed to the photo-detecting state. The central processing unit 851*a* determines a key-off timing upon the change of the upper photo-interrupter from the photo-interrupted state to the photo-detecting state. Then, the central processing unit produces the music data code containing the key code information and a pieces of key-off information.

The controlling unit 851 further comprises a MIDI (Musical Instrument Digital Interface) interface 851*i*, and the MIDI interface 851*i* formats the key code information, the key-on information, the hammer velocity information, the key-off information into a MIDI code for communicating with another musical instrument. The hammer velocity is corresponding to a key velocity, and the key-on timing is indicative of the arrival at position M2. A series of MIDI codes may be supplied from another musical instrument to the MIDI interface 851*i*. Then, the MIDI interface 851*i* extracts the key code information, the key-on information, the key velocity information and the key-off information from the MIDI code, and transfers these pieces of information to the central processing unit 851*a*. Thus, the MIDI interface 851*i* allows the keyboard musical instrument according to the present invention to achieve an ensemble together with other musical instruments. An electronic accompaniment instrument can determine chords of a melody. If the MIDI codes are supplied to the electronic accompaniment instrument, a player can perform a music by generating a melody on the keyboard only.

If the player instructs the direct output, the music data codes are output through the MIDI interface 851*i* to another musical instrument.

The controlling unit 851 further comprises an actuator interface 851*j* connected to the solenoid-operated actuator units 854, and the actuator interface 851*j* selectively supplies the driving current to the solenoid-operated actuator units 854 under the control of the central processing unit 851*a*. The amount of driving current is in proportion to the hammer/key velocity, and the driving current is supplied to each key 111/112 at the key-on timing. On the other hand, the actuator interface 851*j* stops the driving current at the key-off timing, and the depressed key 111/112 returns toward the rest position.

The controlling unit 851 further comprises a motor driver unit 851*k* connected to the motor units 325 and 831, and the motor driver unit 851*k* supplies the driving current to the motor units 325 and 831.

An external memory unit 860 is provided for storing the music data codes, and is implemented by a floppy disk system in this instance. In the recording mode, the music data codes are supplied from the random access memory unit 851*c* to the external memory unit 860 for storing the music data codes on a floppy disk (not shown), and the external memory unit 860 transfers the stored music data codes to a specified memory area of the random access memory unit 851*c*.

The controlling unit 851 further comprises a tone generator 851*m* for generating an audio signal AD tailored on the basis of the key code information, the key-on information, the key-off information and the hammer velocity information of the music data codes in the playback mode. Namely, the central processing unit 851*a* sequentially supplies the music data codes to the tone generator 851*m* in the playback mode, and causes the toner generator 851*m* to generate the audio signal AD. The tone generator 851*m* memorizes not only the waveform pattern of the acoustic piano sound but also other waveform patterns of different sounds, and the player can select one of the waveform patterns by manipulating one of the panel switches 851*d*.

In the playback mode, the tone generator 851*m* starts the read-out of the selected waveform pattern at the key-on timing, and continuously reads out the waveform pattern at a certain speed corresponding to the key code. For this reason, the audio signal AD is regulated to a frequency corresponding to the key code, and the envelope and the amplitude are controlled with the hammer/key velocity. When the tone generator 851*m* terminates or decays the audio signal AD for the supplied key code at the key-off timing depending upon the selected timbre.

The audio signal AD is supplied to the headphone 853. If the electronic system 850 is equipped with a speaker system 870, the audio signal AD is supplied to the speaker system in parallel to or instead of the headphone 853.

Standard Acoustic Mode/Recording/Direct Output

Figure 19:
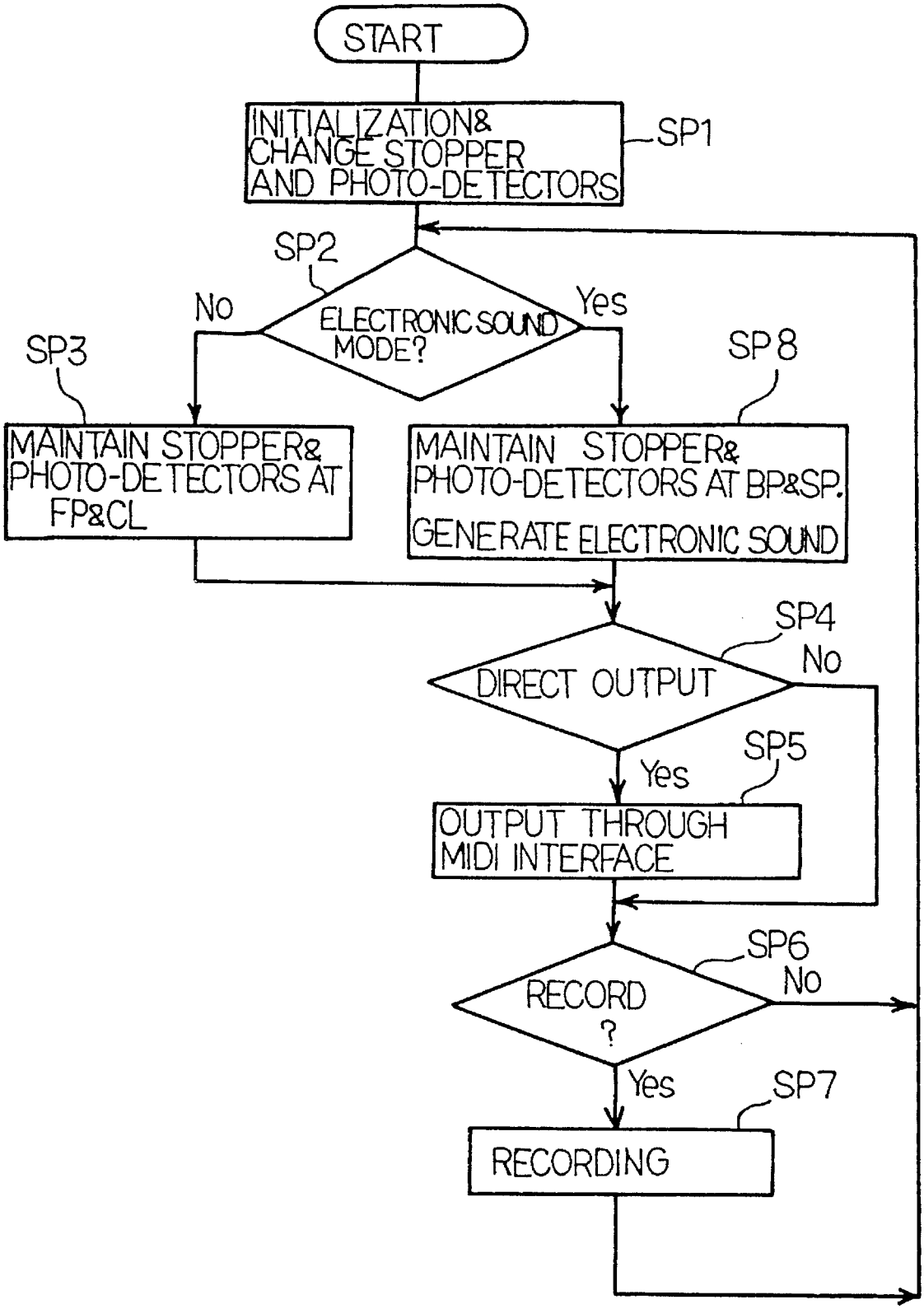
FIG. 19 is a flow chart showing a recording program sequence.

Assuming now that a player wants to perform a music in the standard acoustic sound mode, the player starts the performance on the keyboard 110 without manipulation of the silent switch 851*e*, and the central processing unit 851*a* starts to execute the recording program sequence shown in FIG. 19.

The central processing unit 851*a* firstly initializes internal registers and other available facilities as by step SP1, and changes the stopper unit 250 and the photo-detectors 312 to the free position FP and the closed position CL, if necessary. Thereafter, the central processing unit 851*a* repeats the following loop upon detection of a key-on/key-off event.

The central processing unit 851*a* checks the internal registers to see whether or not the player selects a performance with the electronic sounds as by step SP2. As described hereinbefore, the player did not manipulate the silent switch 851*e*, the answer at step SP2 is given negative.

With the negative answer, the central processing unit 851*a* proceeds to step SP3, and instructs the motor driver unit 851*k* to maintain the stopper unit 250 and the photo-detectors 312 at the free position FP and the closed position CL. If the stopper unit 250 and/or the photo-detectors 312 are at the opposite position or positions, the motor driver unit 851*k* supplies the driving current to the motor unit or units 831/325, and changes the stopper unit 250 and/or the photo-detectors 312 to the free position FP and/or the closed position CL.

The central processing unit 851*a* proceeds to step SP4, and checks the internal registers to see whether or not the player requests the direct output. If the player instructs the direct output through one of the panel switches 851*d*, the answer at step SP4 is given affirmative, and the central processing unit 851*a* supplies the music data code to the MIDI interface 851*i*, and the MIDI interface 851*i* supplies a MIDI code to the outside. Thereafter, the central processing unit 851*a* proceeds to step SP6.

On the other hand, if the player did not request the direct output, the answer at step SP4 is given negative, and the central processing unit 851*a* proceeds to step SP6 without an execution of step SP5. At step SP6, the central processing unit 851*a* checks the internal registers to see whether or not the player requests a recording. If the recording switch 851*f* was manipulated, the answer at step SP6 is given affirmative, and the central processing unit 851*a* proceeds to step SP7 for storing the music data code. Namely, the key code information, the key-on information and the key/hammer velocity information are coded into the music data code, and the central processing unit 851*a* writes the music data code into the random access memory device 851*c*. On the other hand, when a depressed key is released, the central processing unit codes the key-off information and the key code information, and writes the music data code into the random access memory device 851*c*. If a piece of key-on information or a piece of key-off information has been already recorded, a duration data information indicative of the time interval from the piece of key-on/key-off information is further written into the random access memory device 851*c*. Upon completion of step SP7, the central processing unit 851*a* returns to step SP2.

On the other hand, if the player did not request the recording, the answer at step SP6 is given negative, and the central processing unit 851*a* returns to step SP2 without an execution of step SP7. Thus, the central processing unit 851*a* reiterates the loop consisting of steps SP2 to SP7 in the standard acoustic sound mode.

Thus, the controlling unit 851 allows a player to perform a music on the keyboard 110, and concurrently carries out the recording and/or direct output to another musical instrument.

Electronic Sound Mode/Recording/Direct Output

If the player starts the performance after the manipulation of the silent switch 851*e*, the central processing unit 851*a* changes the stopper unit 250 and the photo-detectors 312 to the blocking position BP and the spaced position SP, and the answer at step SP2 is given affirmative. Then, the central processing unit 851*a* proceeds to step SPS, and instructs the motor driver unit 851*k* to maintain the stopper unit 250 and the photo-detectors 312 at the blocking position BP and the spaced position SP as by step SP8.

In step SPS, the central processing unit 851*a* generates a music data code, and supplies the music data code to the tone generator 851*m*. Since the photo-detectors 312 are spaced from the strings 150, the key-on information contains a time delay calculated through dividing the distance between the closed position CL and the spaced position SP by the hammer velocity. If the distance is 10 millimeters and the hammer velocity is 5 m/sec., the time delay of 2 millisecond is introduced, and the impact timing is delayed. The relation between the hammer velocity and the time delay is stored in the read only memory unit 851*b*. The time delay may be calculated by using a certain equation inserted into the program sequence. As a result, the electronic sound is produced at the same timing as the corresponding acoustic sound.

While the player is performing a music in the electronic sound mode, the central processing unit 851*a* reiterates the loop consisting of steps SP2, SP8 and SP4 to SP7, and the player can hear the electronic sounds through the headphone 853. In the electronic sound mode, if the direct output and/or the recording is instructed, the central processing unit 851*a* carries out the direct output and/or the recording at steps SP5 and SP7.

If a sequencer is connected to the MIDI interface 851*i*, the performance is recorded by the external sequencer.

Playback Through Acoustic Sounds

Figure 20:
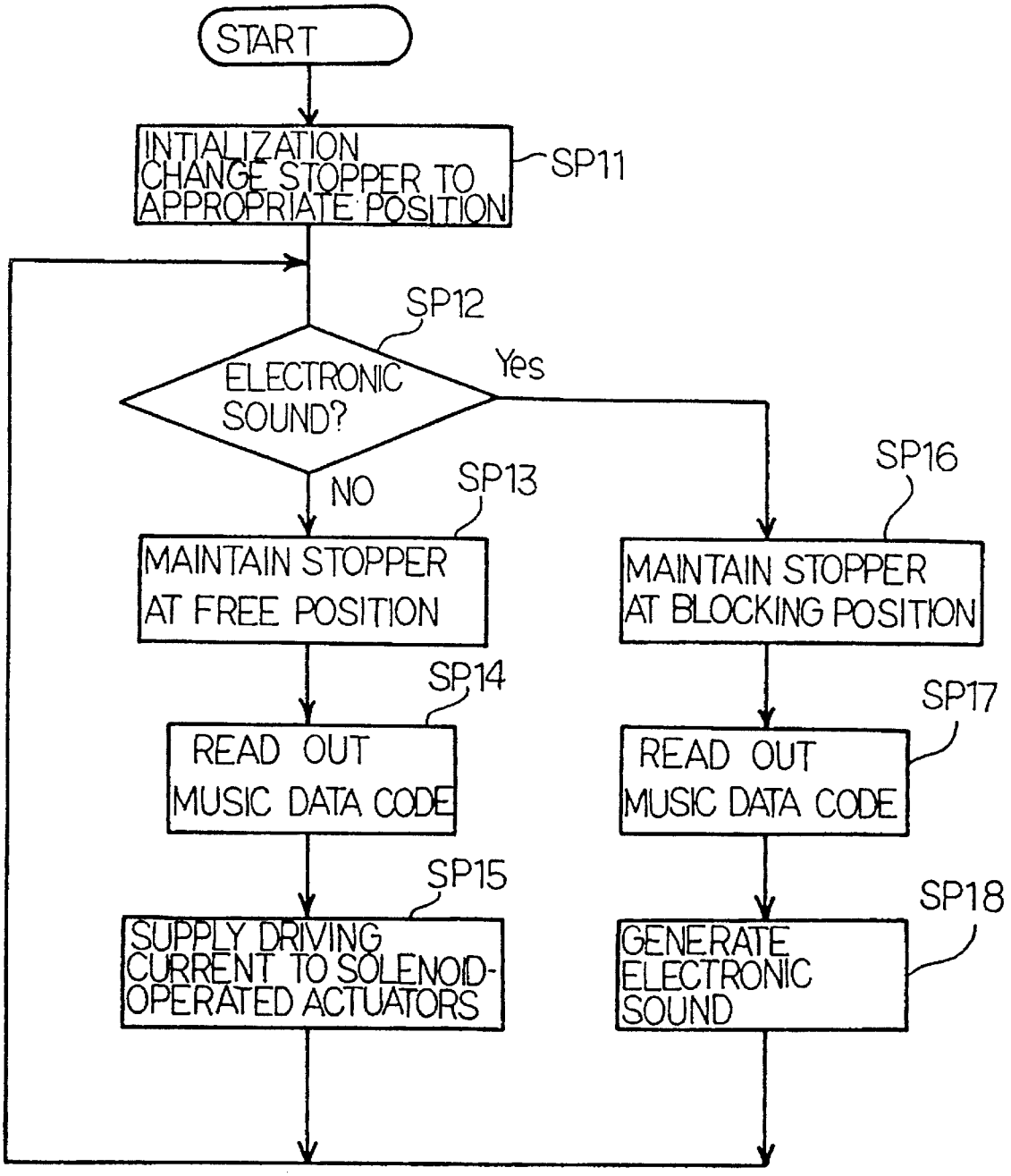
FIG. 20 is a flow chart showing a playback program sequence.

Assuming now that a series of music data codes representing a performance is stored in the random access memory device, the player manipulates the playback switch 851*g*: however, the silent switch 851*e* is not manipulated. Then, the central processing unit 851*a* starts the playback program sequence shown in FIG. 20.

The central processing unit 851*a* initializes the internal registers, and changes the stopper unit 250 to the free position FP as by step SP11. At step SP11, the tempo is provided by the player through manipulation of the panel switch 851*d*.

The central processing unit 851*a* proceeds to step SP12, and checks the internal registers to see whether the player requests the acoustic sounds or the electronic sounds. The player requests the acoustic sounds, and the answer at step SP12 is given negative.

With the negative answer, the central processing unit 851*a* proceeds to step SP13, and maintains the stopper unit 250 at the free position FP.

Subsequently, the central processing unit 851*a* reads out the music data code through an interruption as by step SP14, and the timing of interruption is corresponding to the tempo given by the player. Twenty-four interruptions may take place for each crotchet. the duration data is firstly read out, and is decremented at every tempo clock. When the duration data reaches zero, the next music data code is read out. Thus, the music data codes are sequentially read out at the same timings as the recording mode.

The central processing unit 851*a* proceeds to step SP15, and the central processing unit 851*a* instructs the actuator interface 851*j* to supply the driving current to the solenoid-operated actuator unit 854 assoicated with the key identified by the key code information. The amount of the driving current is proportional to the hammer velocity, and the key 111/112 causes the key action mechanism 120 to rotate teh hammer assembly 130. The hammer assembly 130 impacts on the strings 150 at the same intensity as the original performance.

The central processing unit 851*a* reiterates the loop consisting of steps SP12 to SP15, and the original performance is reproduced by controling the solenoid-operated actuator units 854.

Playback Through Electronic Sounds

If the player manipulates the silent switch 851*e* and the playback switch 851*g*, the central processing unit 851*a* instructs the motor driver unit 851*k* to change the stopper unit 250 to the blocking position BP. Therefore, even if a key 111/112 is mistakenly depresed, the stopper unit 250 blocks the strings 150 from the hammer head 133.

In this situation, the answer at step SP12 is given affirmative, and the central processing unit 851*a* proceeds to step SP16 so as to maintain the stopper unit 250 at the blocking position BP.

Subsequently, the central processing unit 251*a* proceeds to step SP17, and reads out the music data code through the interruption as similar to step SP14. The central processing unit 851*a* transfers the read-out music data code to teh tone generator 851*m*, and the tone generator 851*m* produces the audio signal AD as by step SP18.

Thus, the central processing unit 851*a* reiterates the loop consisting of steps SP12 and SP16 to SP18, and the player can hear the reproduced performance through the headphone 853 and/or the speaker system 870.

Modification of Seventh Embodiment

In the seventh embodiemnt, the central processing unit 851*a* retards the key-on timing in the recording of the electronic sounds. The first modification may rewrite the impact timing, and hte second modification may introduce the time delay into the duration data. The duratin data represents the time interval from the previous event and the delay time. If the movemant between the closed position CL and the spaced position SP is causative of error in the caculation of the hammer velocity, hte central processing unit 851*a* may correct the hammer velocity.

EIGHT EMBODIMENT

Figure 21:
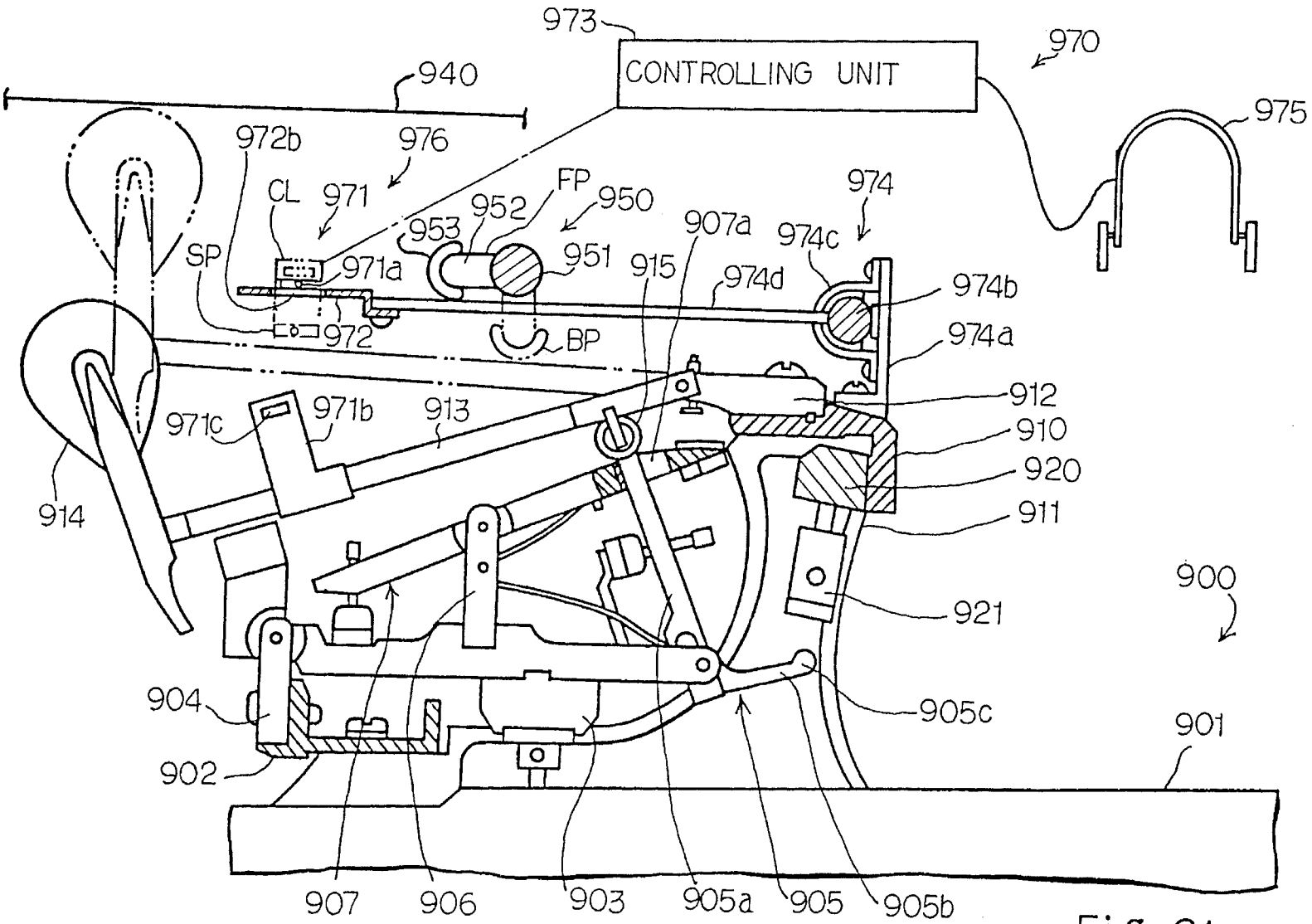
FIG. 21 is a side view showing essential parts of a modification of the keyboard musical instrument according to the present invention.

Turning to FIG. 21 of the drawings, a keyboard muscal instrument embodying the present invention comprises a grand piano 900, a silent system 950 and an electronic system 970. The grand piano 900 is of a standard type.

The grand piano 900 comprises a plurality of black and white keys 901 turnable with respect to a frame (not shown). However, only one of the keys 901 and assoicated mechanisms are described hereinbelow.

Reference numeral 902 designates a whippen support rail, and a whippen assembly 903 is rotatably supported by a whippen flange 904 fixed to the whippen support rail 902. A jack 905 is turnably supported by the whippen assembly 903 at the opposite end to the whippen flange 904, and has a long portion 905*a* and a short portion 905*b* merged with the long portion 905*a* at the right angle.

A flange 906 is upright at the middle portion of the whippen assembly 903, and a repetition lever 907 is turnably supported by the flange 906. A through hole 907*a* is formed at one end portion of the repetition lever 907, and the long portion 906*a* of the jack 905 passes through the through hole 907*a*.

A shank rail 910 is supported by action bracket 911, and a shank flange 912 is fixed to the shank rail 910. A hammer shank 913 is swingably supported by the shank flange 912, and a hammer head 914 is fixed to the leading end of the hammer shank 913. A hammer roller 915 is rotatably connected to the lower surface of the hammer shank 913, and is slightly spaced over the top surface of the long portion 905*a* of the jack 905 at the home position.

A regulating rail 920 is fixed to the hammer shank rail 910, and a regulating button 921 downwardly projects from the lower surface of the regulating rail 920. The regulating button 921 is opposed to the toe 905*c* of the jack 905, and the gap between the toe 905*c* and the regulating button 921 is adjustable by turning the regulating button 921.

The silent system 950 comprises a rotatable shaft member 951, stopper members 952 fixed to the rotatable shaft member 951 and cushion members 953 of artificial leather attached to the stopper members 952. Though not shown in FIG. 21, a link mechanism is connected to the rotatable shaft member 951, and a nob or a pedal is provided for manipulating the link mechanism. An electric motor unit may be connected to the rotatable shaft member 951 instead of the link mechanism, and the rotatable shaft member 951 changes the stopper members and the cushion members between the free position FP and the blocking position BP. The link mechanism and the motor unit may be similar to those of the first embodiment.

While the silent system 950 is in the free position, the hammer head 914 strikes a set of strings 940 without an interruption of the cushion member 953, and the strings 940 vibrate so as to produce an acoustic sound. On the other hand, if the silent system 950 is changed to the blocking position BP, the hammer shank 913 rebounds on the cushion member 953 before the strike of the hammer head 914.

The electronic system 970 comprises a photo-detector 971 supported by a bracket 972, a controlling unit 973 connected to the photo-detector 971, a change-over mechanism 974 and a headphone 975. A photo-emitting element (not shown), a photo-detecting element (not shown) and optical fibers 971*a* form the photo-detector 971, and the photo-detector 971 and a shutter plate 971*b* with a slit 971*c* form a hammer sensor 976. A slit 972*b* is formed in the bracket member 972, and allows the shutter plate 971*b* to pass therethrough for interrupting an optical path between the optical fibers 971*a*.

The change-over mechanism 974 is similar to the change-over mechanism 320 of the first embodiment, and comprises a bracket member 974*a* fixed to the hammer shank rail 910, a rotatable shaft member 974*b*, bearing units 974*c* for rotatably supporting the shaft member 974*b* and a frame 974*d* connected between the rotatable shaft member 974*b* and the bracket 972.

The change-over mechanism 974 changes the hammer sensor 976 between the close position CL and the spaced position SP, and the hammer sensor 976 in the spaced position can monitor the hammer motion rebounding on the cushion member 953. On the other hand, the hammer sensor 976 in the closed position monitors the hammer motion rebounding on the strings 940, and supplies a hammer position signal to the controlling unit 973.

The keyboard musical instrument shown in FIG. 21 selectively enters into an acoustic sound mode and an electronic sound mode. In the acoustic sound mode, the player selectively depresses the keys 901, and performs a music through acoustic sounds. The hammer sensor 976 in the close position CL causes the controlling unit 973 to determine a hammer velocity, a key-on timing, a key code of a depressed key and a key-off timing, and the controlling unit 973 produces a music data code containing the key code information, the key-on timing information and the key velocity information for a depressed key 901 and a music data information containing the key code information and the key-off timing information for a released key 901. The music data codes may be directly output to another electronic musical instrument or a sequencer, and/or stored in an internal memory of the controlling unit 973.

In the electronic sound mode, the hammer shank 913 rebounds on the cushion member 953 in the blocking position, and the hammer sensor 976 in the spaced position SP causes the controlling unit 973 to produce the music data codes as similar in the acoustic sound mode. A time delay is introduced as described in conjunction with the seventh embodiment.

The music data codes are transferred to a tone generator incorporated in the controlling unit 973, and the tone generator tailors an audio signal for reproducing the performance through the headphone 975.

Although particular embodiments of the present invention have been shown and described, it will be obvious to those skilled in the art that various changes and modifications may be made without departing from the spirit and scope of the present invention.

For example, a cembalo, a celesta or an organ are available for the keyboard musical instrument instead of the upright or grand piano. A key sensor may further incorporated in the electronic system, and the detection of the hammer position and the key-on timing may be shared between the hammer sensors and the key sensors.

The first to eighth embodiments may have gap regulating system so as to change the gap between the toes and the regulating buttons between the acoustic sound mode and the electronic sound mode. The gap regulating system may move the regulating buttons or insert spacers beneath the regulating buttons in the electronic sound mode. The gap regulating system may be driven by a motor unit, a solenoid-operated actuator unit or a mechanical link mechanism.

The photo-detector may be implemented by a photo-interrupter without optical fibers, and a non-contact sensor may be used for monitoring the hammer motions instead of the photo-detectors.

What is claimed is:

1. A keyboard musical instrument having at least an acoustic sound mode and an electronic sound mode, comprising:

an acoustic piano including a plurality of keys respectively assigned notes of a scale, and selectively moved between respective rest positions and respective end positions by a player, a plurality of key action mechanisms functionally connected to said plurality of keys, respectively, and selectively actuated said plurality of keys, a plurality of string means vibratory for generating acoustic sounds respectively having said notes, and a plurality of hammer means functionally connected to said plurality of key action mechanisms, respectively, and resting in respective home positions when said plurality of keys are in said respective rest positions, said plurality of hammer means being selectively driven by said plurality of key action mechanisms for striking the associated string means;

a silent system shifted between a free position in said acoustic sound mode and a blocking position in said electronic sound mode, said silent mechanism in said free position allowing said plurality of hammer means to strike said plurality of string means, said silent mechanism in said blocking position causing said plurality of hammer means driven by said plurality of key action mechanisms to return to said home positions on the way to said plurality of string means without a strike; and an electronic system including a plurality of hammer sensors respectively associated with said plurality of hammer means, and operative to generate detecting signals respectively indicative of motions of said plurality of hammer means, a change-over mechanism connected to said plurality of hammer sensors, and shifting said plurality of hammer sensors between a closed position in said acoustic sound mode and a spaced position in said electronic sound mode, said closed position being closer to said plurality of string means than said spaced position, and a data signal generating means responsive to said detecting signal for generating pieces of music data indicative of a performed music.

2. The keyboard musical instrument as set forth in claim 1, in which said electronic system further includes a recording means for recording said pieces of music data in at least one of said acoustic sound mode and said electronic sound mode.

3. The keyboard musical instrument as set forth in claim 1, in which said electronic system further includes a plurality of actuator units respectively associated with said plurality of keys, and operative to move said plurality of keys between said rest positions and said end positions instead of said player, and a playback means responsive to said pieces of music data for selectively supplying driving current to said plurality of actuator units for moving the associated keys.

4. The keyboard musical instrument as set forth in claim 1, in which said electronic system further includes a recording means for recording said pieces of music data in at least one of said acoustic sound mode and said electronic sound mode, a plurality of actuator units respectively associated with said plurality of keys, and operative to move said plurality of keys between said rest positions and said end positions instead of said player, and a playback means responsive to said pieces of music data for selectively supplying driving current to said plurality of actuator units for moving the associated keys.

5. The keyboard musical instrument as set forth in claim 1, in which a photo emitting and detecting unit for generating an optical path and a shutter plate attached to one of said hammer means for interrupting said optical path form in combination each of said plurality of hammer sensors, and said change-over mechanism includes a support means supporting the photo-sensors of said plurality of hammer sensors and angularly movable around a center axis, and a driving means operative to angularly move said support means for changing said hammer sensors between said closed position and said spaced position.

6. The keyboard musical instrument as set forth in claim 5, in which said photo emitting and detecting unit has a photo-emitting element for generating a light beam, a first optical fiber connected to said photo-emitting element, a photo-detecting element for generating said detecting signal and a second optical fiber connected to said photo-detecting element, an outlet end of said first optical fiber being opposed to an outlet end of said second optical fiber such that said optical path bridges over a space where said shutter plate passes.

7. The keyboard musical instrument as set forth in claim 1, in which a photo emitting and detecting unit for generating an optical path and a shutter plate attached to one of said hammer means for interrupting said optical path form in combination each of said plurality of hammer sensors, and said change-over mechanism includes a support means supporting the photo-sensors of said plurality of hammer sensors and reciprocally slidable in a space between said plurality of hammer means and said plurality of string means, and a driving means operative to slide said support means for changing said hammer sensors between said closed position and said spaced position.

8. The keyboard musical instrument as set forth in claim 1, in which said plurality of hammer sensors are stationary, and include a plurality of first photo emitting and detecting units for generating respective first optical paths, and first portions of a plurality of shutter plates respectively attached to said plurality of hammer means and interrupting said first optical paths when said plurality of hammer means are moved, said change-over mechanism including a plurality of second photo emitting and detecting units for generating respective second optical paths, and second portions of said plurality of shutter plates interrupting said second optical paths, and a selecting means operative to select said plurality of first photo emitting and detecting units and said first portions in said acoustic sound mode, said selecting means selecting said plurality of second photo emitting and detecting units and said second portions in said electronic sound mode.

9. The keyboard musical instrument as set forth in claim 8, in which each of said plurality of first photo emitting and detecting units and one of said plurality of second photo emitting and detecting units associated with said each of said plurality of first photo emitting and detecting units are located on a common virtual line declining at a certain angle with respect to one of said plurality of hammer means at said home position, and said first portions are offset to said second portions so as to interrupt one of said first optical paths and one of said second optical paths at different timings, respectively.

10. The keyboard musical instrument as set forth in claim 8, in which said plurality of first photo emitting and detecting units are offset to said plurality of second photo emitting and detecting units, respectively, and said first portions are separated to said second portions so as to interrupt said first optical paths and said second optical paths at different timings.

11. The keyboard musical instrument as set forth in claim 1, in which said plurality of hammer sensors include respective photo emitting and detecting units generating optical paths, and first portions of a plurality of shutter plates respectively attached to said plurality of hammer means and interrupting said optical paths, and said change-over mechanism includes second portions of said plurality of shutter plates interrupting said optical paths at different timings from said first portions, and a selecting means for selecting said detecting signals generated by said first portions or said detecting signals generated by said second portions.

12. The keyboard musical instrument as set forth in claim 1, in which said plurality of hammer means include respective hammer butts respectively kicked by said plurality of key action mechanisms, respective hammer shanks projecting from said hammer butts, respectively, respective hammers fixed to said hammer shanks for striking said plurality of string means, respective back checks respectively fixed to said plurality of key action mechanisms, and respective catchers projecting from said hammer butts and angularly spaced from said hammer shanks, and said plurality of hammer sensors include respective shutter plates fixed to said hammer shanks, and respective photo emitting and detecting units having optical paths interrupted by said shutter plates, respectively.

13. The keyboard musical instrument as set forth in claim 1, in which said plurality of hammer means include respective hammer butts respectively kicked by said plurality of key action mechanisms, respective hammer shanks projecting from said hammer butts, respectively, respective hammers fixed to said hammer shanks for striking said plurality of string means, respective back checks respectively fixed to said plurality of key action mechanisms, and respective catchers projecting from said hammer butts and angularly spaced from said hammer shanks, and said plurality of hammer sensors include respective shutter plates fixed to said catchers, and respective photo emitting and detecting units having optical paths interrupted by said shutter plates, respectively.

14. The keyboard musical instrument as set forth in claim 1, in which said plurality of hammer means include respective hammer butts respectively kicked by said plurality of key action mechanisms, respective hammer shanks projecting from said hammer butts, respectively, respective hammers fixed to said hammer shanks for striking said plurality of string means, respective back checks respectively fixed to said plurality of key action mechanisms, and respective catchers projecting from said hammer butts and angularly spaced from said hammer shanks, and said system includes a catcher stopper opposed to said catchers of said plurality of hammer assemblies in said home positions, and a driving unit for changing said catcher stopper between said free position and said blocking position, said catchers rebounding on said catcher stopper in said blocking position.

15. The keyboard musical instrument as set forth in claim 14, in which said driving unit rotates said catcher stopper between said free position and said blocking position.

16. The keyboard musical instrument as set forth in claim 14, in which said driving unit slides said catcher stopper between said free position and said blocking position.

17. The keyboard musical instrument as set forth in claim 1, in which said plurality of hammer means include respective hammer butts respectively kicked by said plurality of key action mechanisms, respective hammer shanks projecting from said hammer butts, respectively, respective hammers fixed to said hammer shanks for striking said plurality of string means, respective back checks respectively fixed to said plurality of key action mechanisms, and respective catchers projecting from said hammer butts and angularly spaced from said hammer shanks, and said silent system includes a shank stopper opposed to said hammer shanks of said plurality of hammer assemblies in said home positions, and a driving unit for changing said shank stopper between said free position and said blocking position, said hammer shanks rebounding on said shank stopper in said blocking position.

18. The keyboard musical instrument as set forth in claim 17, in which said driving unit rotates said shank stopper between said free position and said blocking position.

19. The keyboard musical instrument as set forth in claim 1, in which said plurality of hammer means include respective hammer butts respectively kicked by said plurality of key action mechanisms, respective hammer shanks projecting from said hammer butts, respectively, respective hammers fixed to said hammer shanks for striking said plurality of string means, respective back checks respectively fixed to said plurality of key action mechanisms, and respective catchers projecting from said hammer butts and angularly spaced from said hammer shanks, and said silent system includes a cushion opposed to said hammers of said plurality of hammer assemblies in said home positions, and a driving unit changing said cushion between said free position and said blocking position, said hammers rebounding on said cushion in said blocking position.

20. The keyboard musical instrument as set forth in claim 1, in which said silent system includes rotatable pulleys, a plurality of strings connected between said rotatable pulleys and said plurality of hammer assemblies, respectively, and a driving unit for rotating said rotatable pulleys between said free position and said blocking position, said plurality of strings connected to said rotatable pulleys in said blocking position causing said plurality of hammer assemblies to return toward said home positions before an impact on said string means.

21. The keyboard musical instrument as set forth in claim 1, further comprising a direct output interface for supplying said pieces of music data to the outside of said keyboard musical instrument.

22. The keyboard musical instrument as set forth in claim 1, in which said electronic system further includes a recording means for recording said pieces of music data in at least one of said acoustic sound mode and said electronic sound mode, and a direct output interface for supplying said pieces of music data to the outside of said keyboard musical instrument.

23. The keyboard musical instrument as set forth in claim 22, further comprising a selecting means for selectively activating said recording means and said direct output interface in at least said acoustic sound mode.

24. The keyboard musical instrument as set forth in claim 22, further comprising a selecting means for selectively activating said recording means and said direct output interface in at least said electronic sound mode.

25. The keyboard musical instrument as set forth in claim 1, in which said acoustic piano is an upright piano.

26. The keyboard musical instrument as set forth in claim 1, in which said acoustic piano is a grand piano.

* * * * *